United States Patent [19]

Block et al.

[11] Patent Number: 4,527,491

[45] Date of Patent: Jul. 9, 1985

[54] BELT LOOP SETTING SYSTEM

[75] Inventors: Charles Block, North Bellmore; Leon Mintz, Syosset, both of N.Y.

[73] Assignee: Joseph Galkin Corporation, Hicksville, N.Y.

[21] Appl. No.: 508,447

[22] Filed: Jun. 27, 1983

Related U.S. Application Data

[63] Continuation-in-part of Ser. No. 206,790, Nov. 14, 1980, Pat. No. 4,389,957.

[51] Int. Cl.[3] ..... D05B 3/20; D05B 23/00

[52] U.S. Cl. ..... 112/104; 112/121.27; 112/152

[58] Field of Search ..... 112/121.27, 121.26, 112/104, 152, 262.3, 265.1, 121.12, 121.15

[56] References Cited

U.S. PATENT DOCUMENTS 3,699,907 10/1972 Anderson et al. ..... 112/104 X
3,792,672 2/1974 Friedman et al. ..... 112/104
3,841,247 10/1974 Off et al. ..... 112/104 X
3,949,688 4/1976 Andersson ..... 112/121.27 X
4,279,209 7/1981 Diacont, Jr. ..... 112/265.1 X

*Primary Examiner*—H. Hampton Hunter
*Attorney, Agent, or Firm*—Paul J. Sutton

[57] ABSTRACT

The present invention teaches a system which, utilizing pneumatic logic, folds and positions pre-cut belt loop material for joinder to pants. The pre-cut material is loaded while joinder is occuring. Two pairs of upstanding pins supported by fingers receive individually cut belt loop fabric pieces which can be made from scrap to match colors and, in a preferred embodiment of this invention, two tacks secure the loop to pants in the case of jeans. A novel adjustable cam control arrangement and means for rotating the fingers is described in the following specification. In a second embodiment, one visible and one invisible tack can be made securing the belt loop to the pants, with the visible and invisible tacks being placed either top and bottom or bottom and top, respectively, as selected.

2 Claims, 48 Drawing Figures

FIG. 1
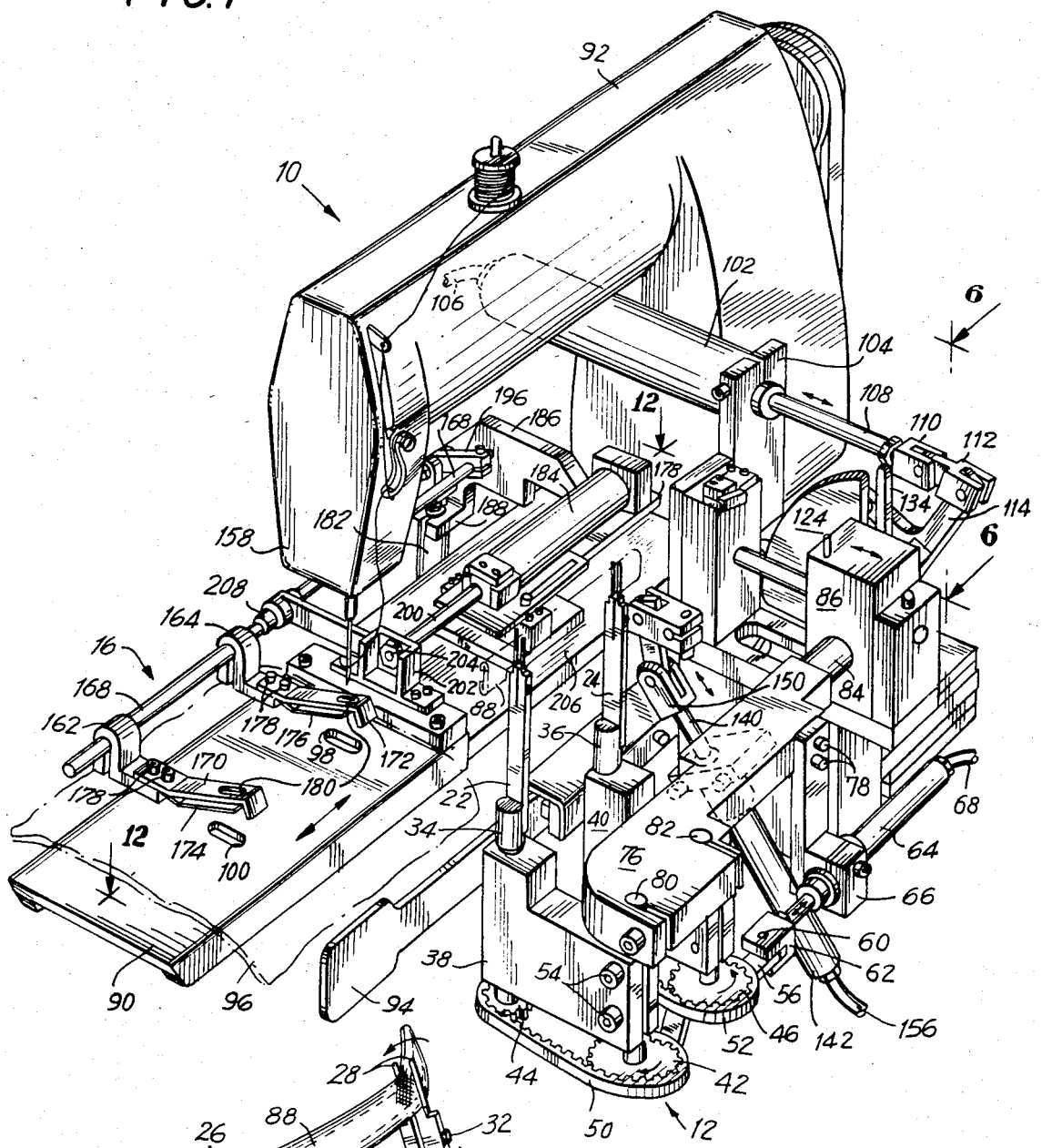
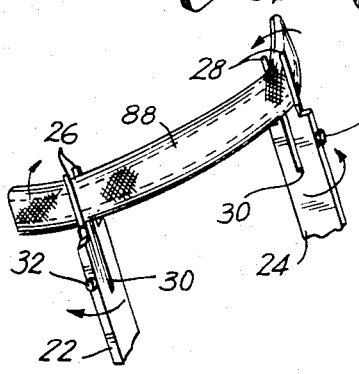
FIG. 1a 13
13
16
16
88
90
96
162
164
168
168
168
178
178
180
182
182
184
184
186
186
188
188
190
192
192
194
196
196
198
198

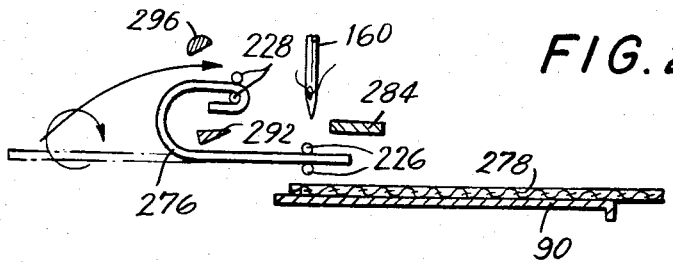
FIG. 20
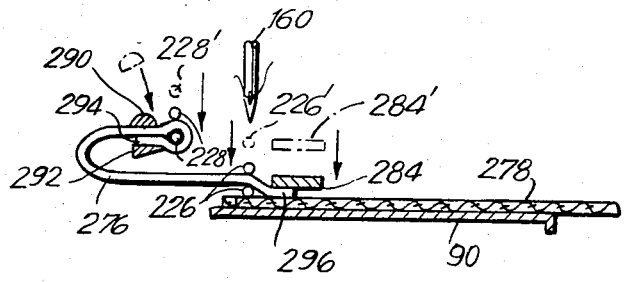
FIG. 21
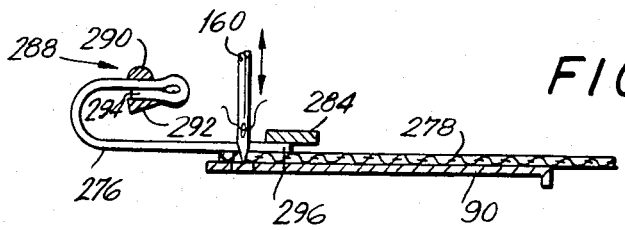
FIG. 22
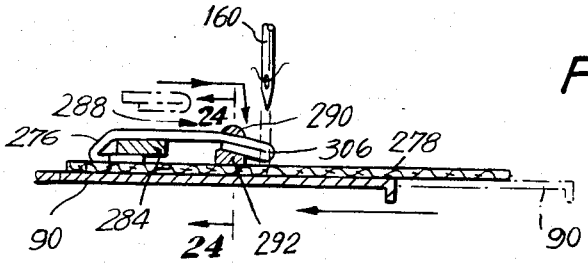
FIG. 23
FIG. 24
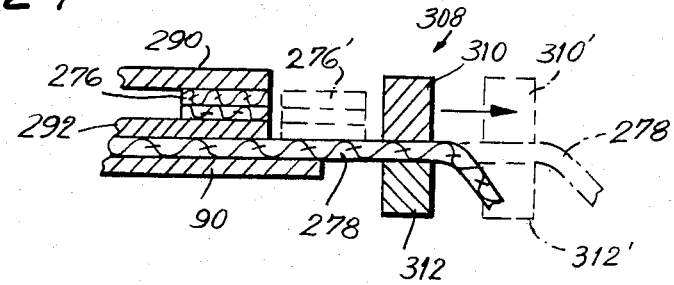

FIG. 37
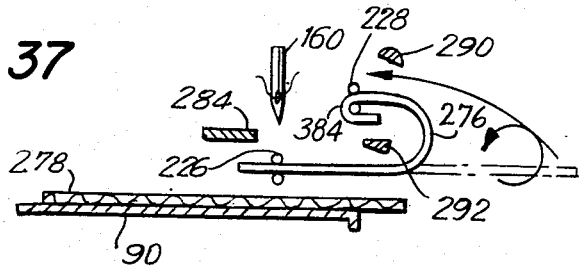
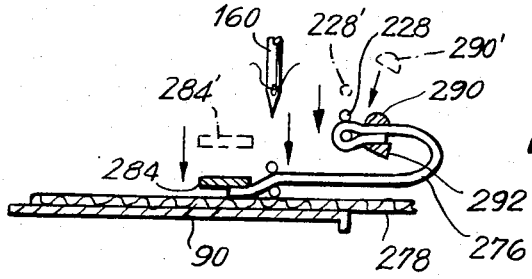
FIG. 38
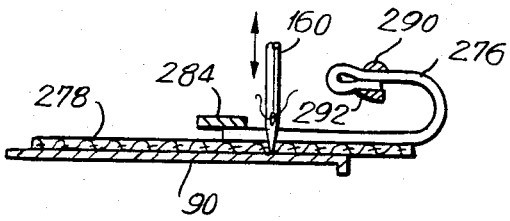
FIG. 39
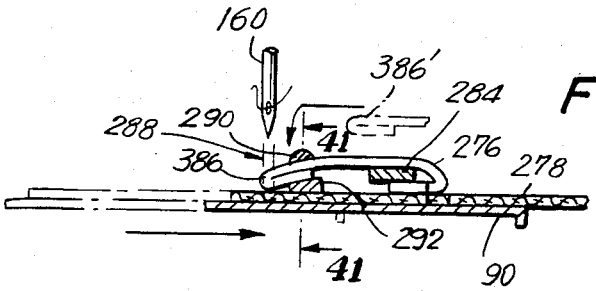
FIG. 40
FIG. 41
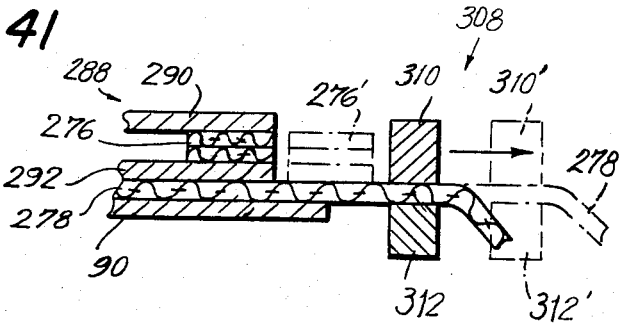

BELT LOOP SETTING SYSTEM

This application is a continuation in part of a pending application filed on Nov. 14, 1980, Ser. No.. 206,790 now U.S. Pat. No. 4,389,957, dated June 28, 1983.

The present invention relates generally to sewing and joining machine attachments, and more particularly to a novel system, method and apparatus for automatically folding, positioning and tacking both ends of a belt loop on a trouser waistband.

A need exists for a sewing machine attachment system which is relatively inexpensive, reduces operator time, is reliable and efficient, and which operates semi-automatically in synchronization with its host sewing machine to repeatedly fold, position and tack belt loops on pants and jeans. A further need exists for a system, as described below, which will facilitate accomplishing these needs utilizing individually pre-cut pieces of fabric in the form of belt loop strips (commonly called "loops"), whose colors can be reliably and more acurately matched to the pants to which they are to be attached.

Belt loop attachment machines now exist, although they possess a number of drawbacks or disadvantages. In the spirit of making the U.S. Patent and Trademark Office aware of what we consider to be relevant known prior developments, a brief discussion of existing machines that are recalled at this time follows.

The Apparel Equipment Division of AMF, located in Richmond, Va., has published promotional literature describing an automatic belt loop machine. This relatively expensive machine, according to this literature, utilizes a continuous supply of belt loop material which is cut and folded and which supposedly automatically attaches belt loops to jean-style pants in a purportedly simple manner requiring relatively unskilled labor. Apart from this equipment appearing relatively complicated and being relatively expensive, we are not able to describe here the exact manner of operation except to say that, by virtue of utilizing continuously fed belt loop material, it cannot possibly operate in the manner of operation of the present invention and system.

Another manufacturer of machinery that has advertised a belt loop attaching machine is the Rochester Button Company, Apparel Equipment Division, of Atlanta, Ga. As in the case of the AMF machinery, the Rochester literature shows equipment which utilizes presewn belt loop material originally supplied from a roll or strip and, during an automatic cycle, the belt loop material that is precut from this continuous spool is folded and positioned on the pants for tacking. It is known that the Rochester company has attempted to utilize individual strips of presewn belt loop material, and all literature in the possession or control of applicants shall be made available to the Examiner of the U.S. Patent and Trademark Office, upon request. It is most respectfully urged that the present invention patentably distinguishes over each and all of this conventional equipment.

Yet another so-called automatic belt loop attaching machine for jeans has been publicized by Tokyo Juki Industrial Co., Ltd., a Tokyo based Japanese company which markets this equipment under the trademark "JUKI". As in the case of the AMF equipment, the Juki system apparently utilizes a roll of presewn belt loop material which is fed into a machine for attachment to heavyweight material such as denim for jeans.

Applicants further wish to bring to the attention of the U.S. Patent and Trademark Office the existence of their own U.S. Pat. Nos. 3,565,711 and 3,587,947, which, while not anticipatory of the present invention as claimed and described, will give the reader an appreciation of problems traditionally encountered in this art.

It is an object of the present invention to provide a belt loop setter and belt loop setting system for use with a conventional commercial sewing machine, or the like. Another object is to provide such a system which utilizes pneumatic logic in its operational controls, as opposed to a fluid hydraulic or electrical control system. In this regard, however, it is contemplated that the present invention may include alternate types of system controls other than the preferred embodiment that will be described hereinbelow.

A further object of this invention is to provide a belt loop setting system which is semi-automatic and which requires relatively short personnel training times and relatively unskilled labor to operate the system efficiently.

Yet another object of our invention is to provide such a system, wherein individual lengths of presewn belt loop material are color matched to apparel to which they are to be attached, and wherein a relatively small or short folding turn-under is accomplished utilizing the apparatus according to the present invention, whereby undesirable wasting of loop material and fraying of the ends of the belt loop material after washing is avoided or eliminated.

Yet a further object of this invention is to provide a belt loop setting system, as above, which is a fraction of the cost of conventional equipment that is believed to currently be on the market at prices which are relatively high to the purchaser and user. Our system has been designed to be reliable, giving repeated consistant results, as demonstrated experimentally at at least one trade show.

Still another object of our invention is to provide a belt loop setter and system which utilizes a cam control attachment with a modified feed bar and which, when operating according to its intended function, facilitates turnunders or bendunders of belt loop materials of approximately $\frac{1}{4}$ of an inch or less, thereby saving material as well as avoiding the fraying mentioned above.

A further object is to provide a system, as above, wherein a novel twirling pin/form or finger arrangement utilizes a non-circular rotation of the twirling pins which fold the belt loop material strip, thereby avoiding a frictional load on these twirling pins and further avoiding sliding of the belt loop material within the space between the pins. This novel arrangement during the forming creates and then eliminates slack in the strip of belt loop material to be sewn or attached to apparel, such as jeans.

Yet a further object of this invention is to provide a belt loop setter and belt loop setting system for use with a conventional commercial sewing machine wherein a novel double action rotation and twirling of one finger holding one end of the belt loop allows an invisible tack to be made to pants either at the top or the bottom of the belt loop as desired.

It is difficult within a short and incomplete description of the several objects of the present invention to fully define the means by which the aforementioned objects are accomplished. Accordingly, this will become far more apparant from a reading of the following specification which is cross-referenced to the drawings, and wherein similar reference characters throughout the specification correspond to those depicted in the views of the attached drawings, wherein:

FIG. 1 is a fragmentary and partial perspective view of the system according to the present invention;

FIG. 1*a* is an enlarged fragmentary perspective view of two pair of pins according to the present invention in and between which a length of belt loop material is situated;

FIG. 2 is a simplified schematic-type fragmentary sectional elevational view of both the sewing station at which a stripper/clamp is situated, as well as what will be referred to here as an inserter which supports upstanding loop forming fingers or pins;

FIG. 2*a* is a view taken along the line 2*a*—2*a* of FIG. 2;

FIG. 2*b* is a view taken along the line 2*b*—2*b* of FIG. 2;

FIG. 3 is a view similar to FIG. 2 of the same sewing station and inserter, but where the next sequential step after folding has been accomplished (FIG. 2) wherein the folding or turnunder is completed and the forming fingers are disposed horizontally;

FIG. 3*a* is a view taken along the line 3*a*—3*a* of FIG. 3;

Figure 5A:
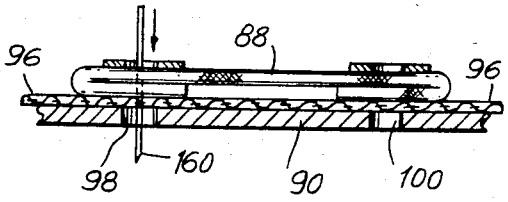
FIG. 5 is a view of the station shown in FIGS. 2–4, but wherein the inserter is shown in broken line as having retracted from the position shown in FIG. 4 and in full line returning to its upright position, and wherein the sewing operation is in progress.
Figure 5:
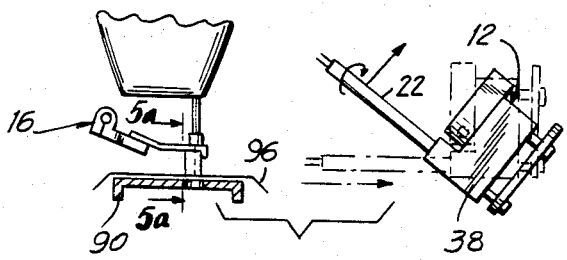
Figure 6:
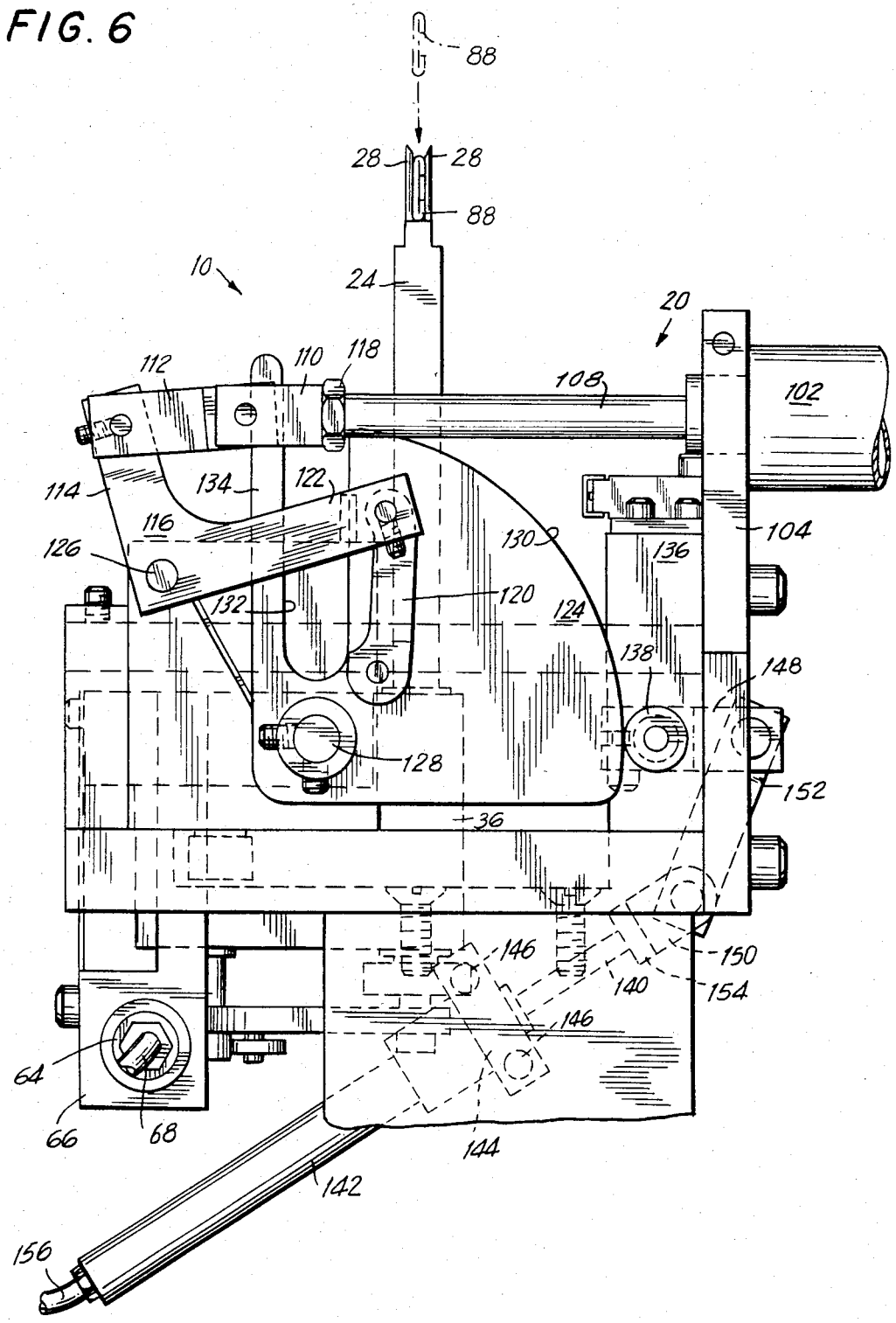
Figure 7:
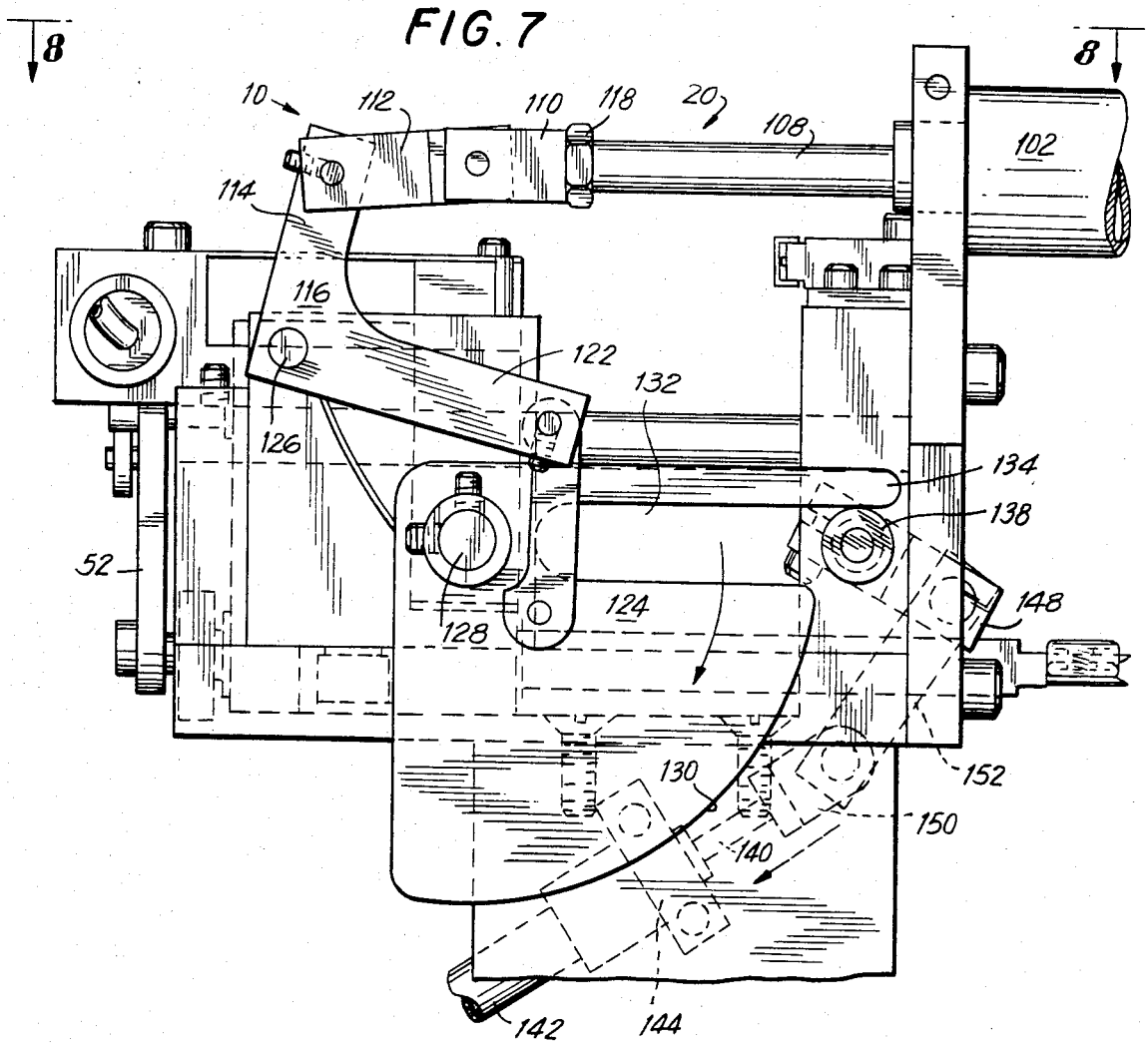
Figure 9:
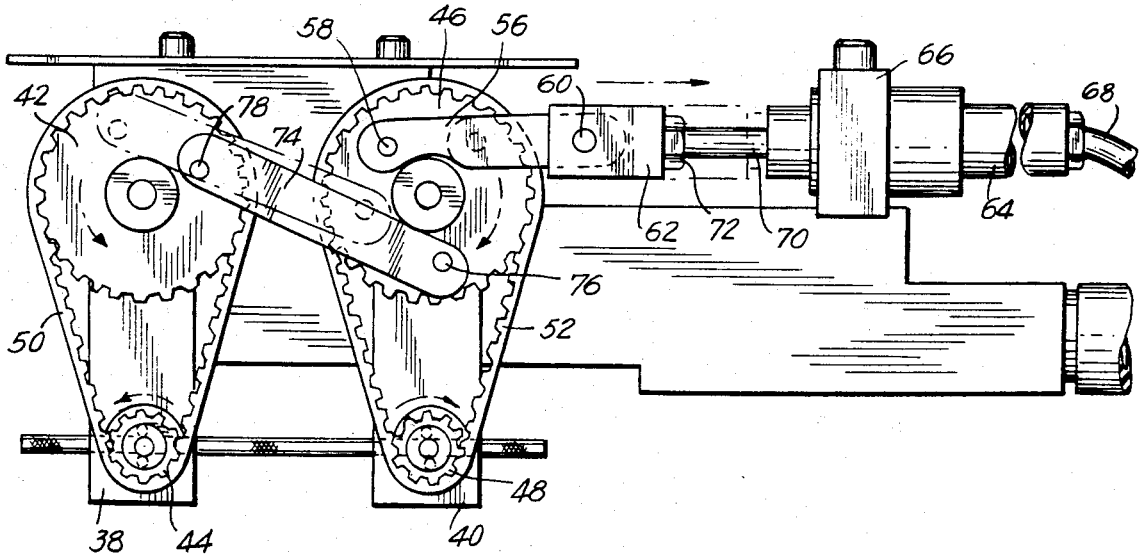
Figure 8:
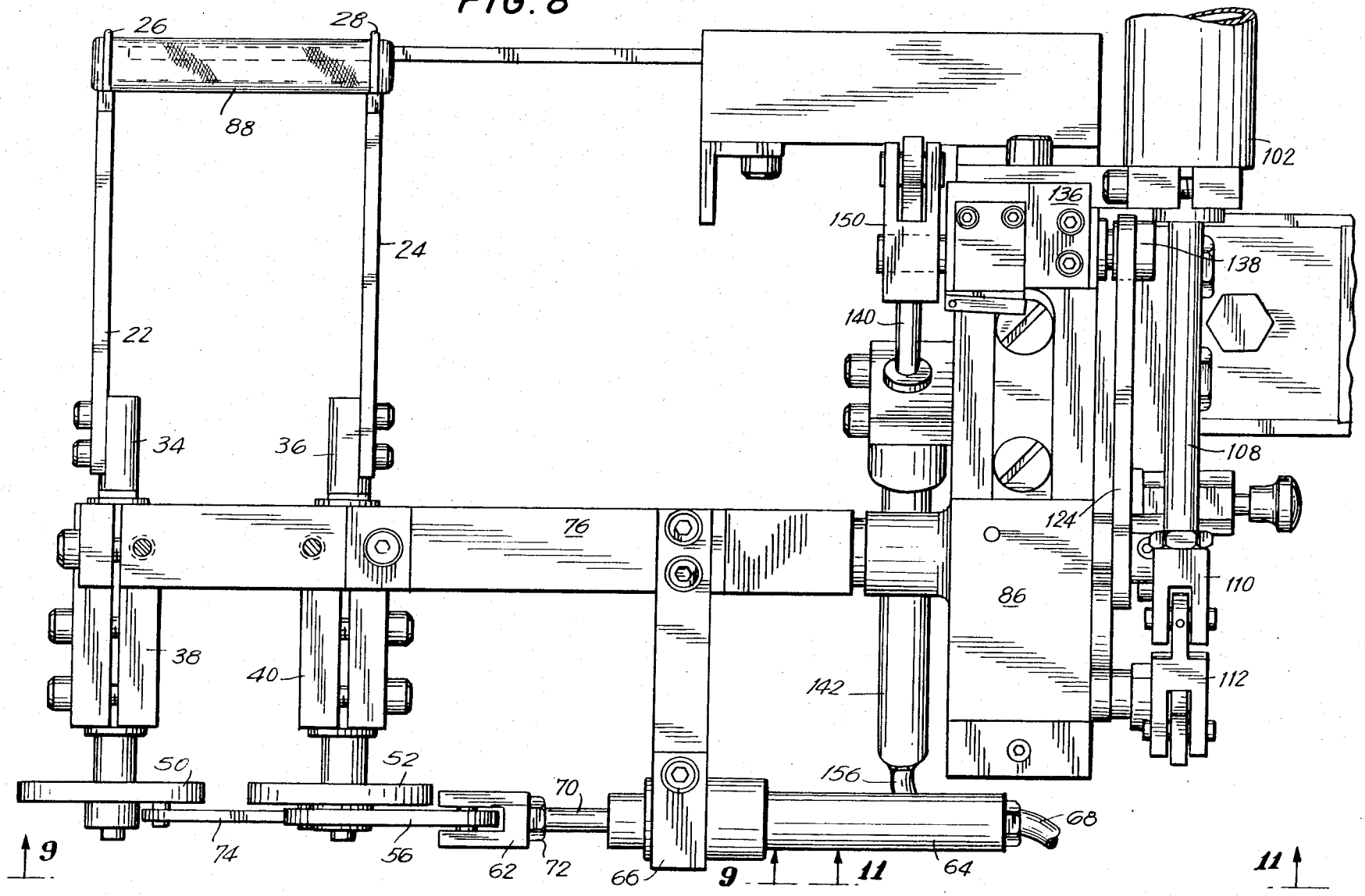
Figure 10:
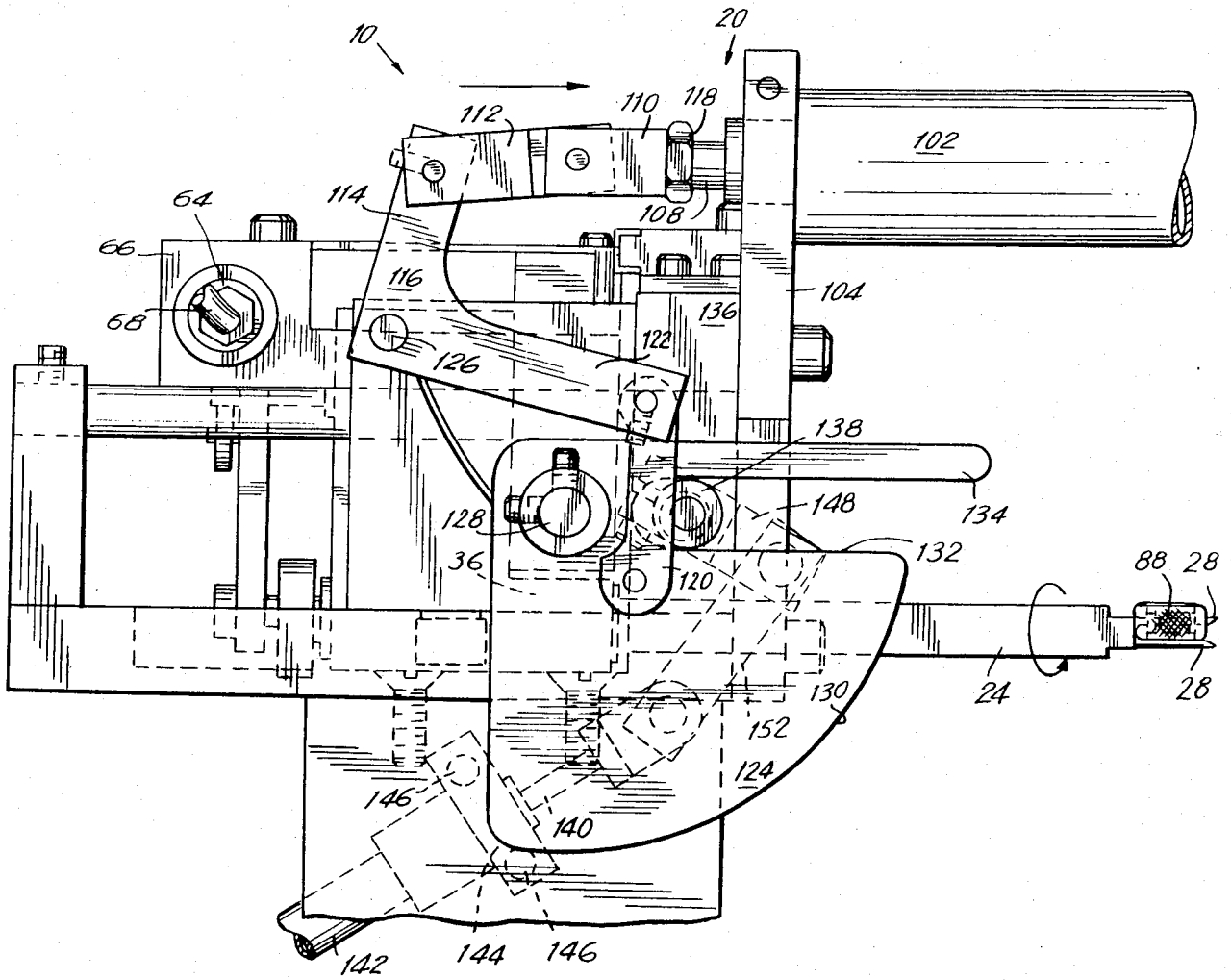
Figure 11:
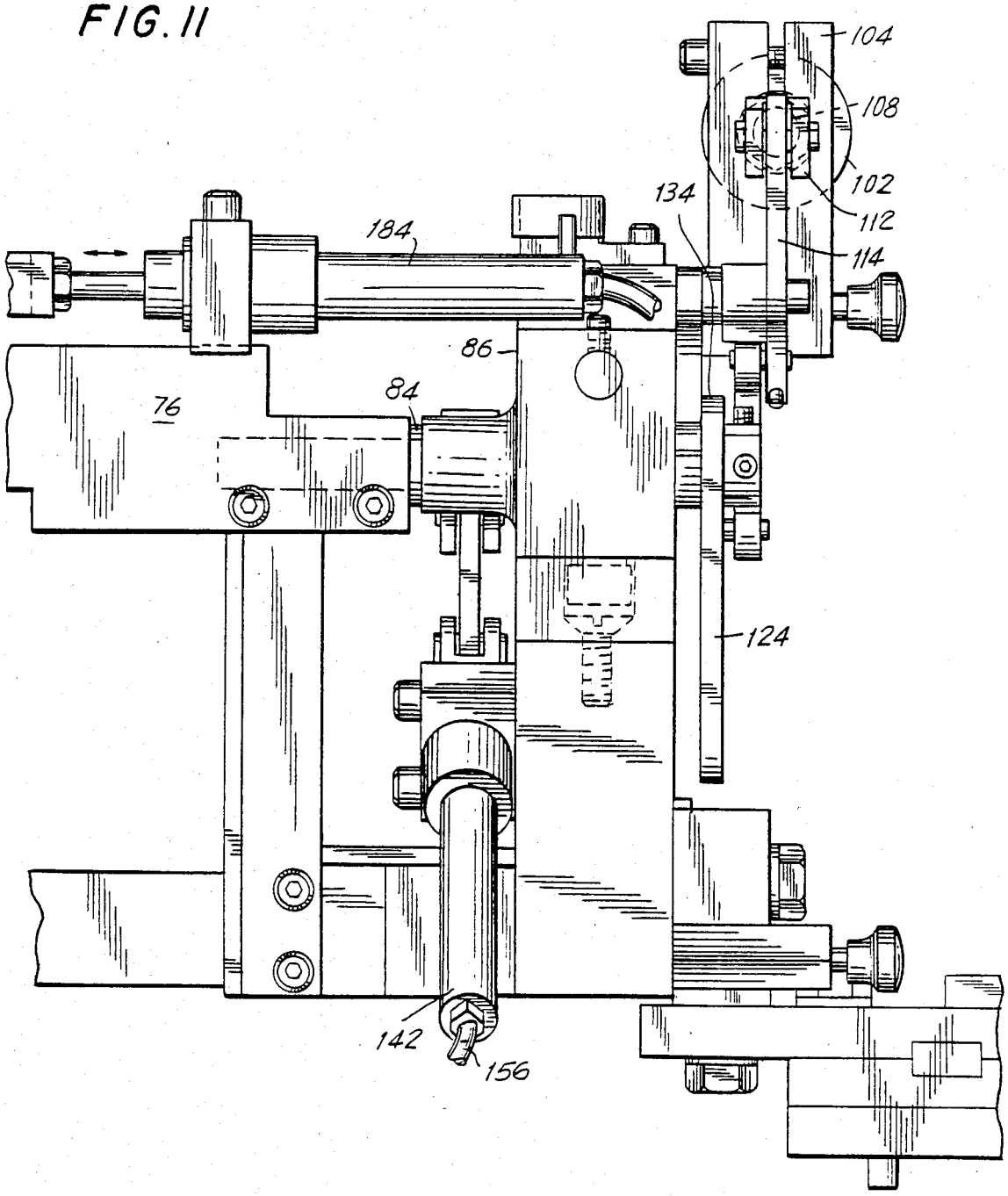
Figures 12, 13:
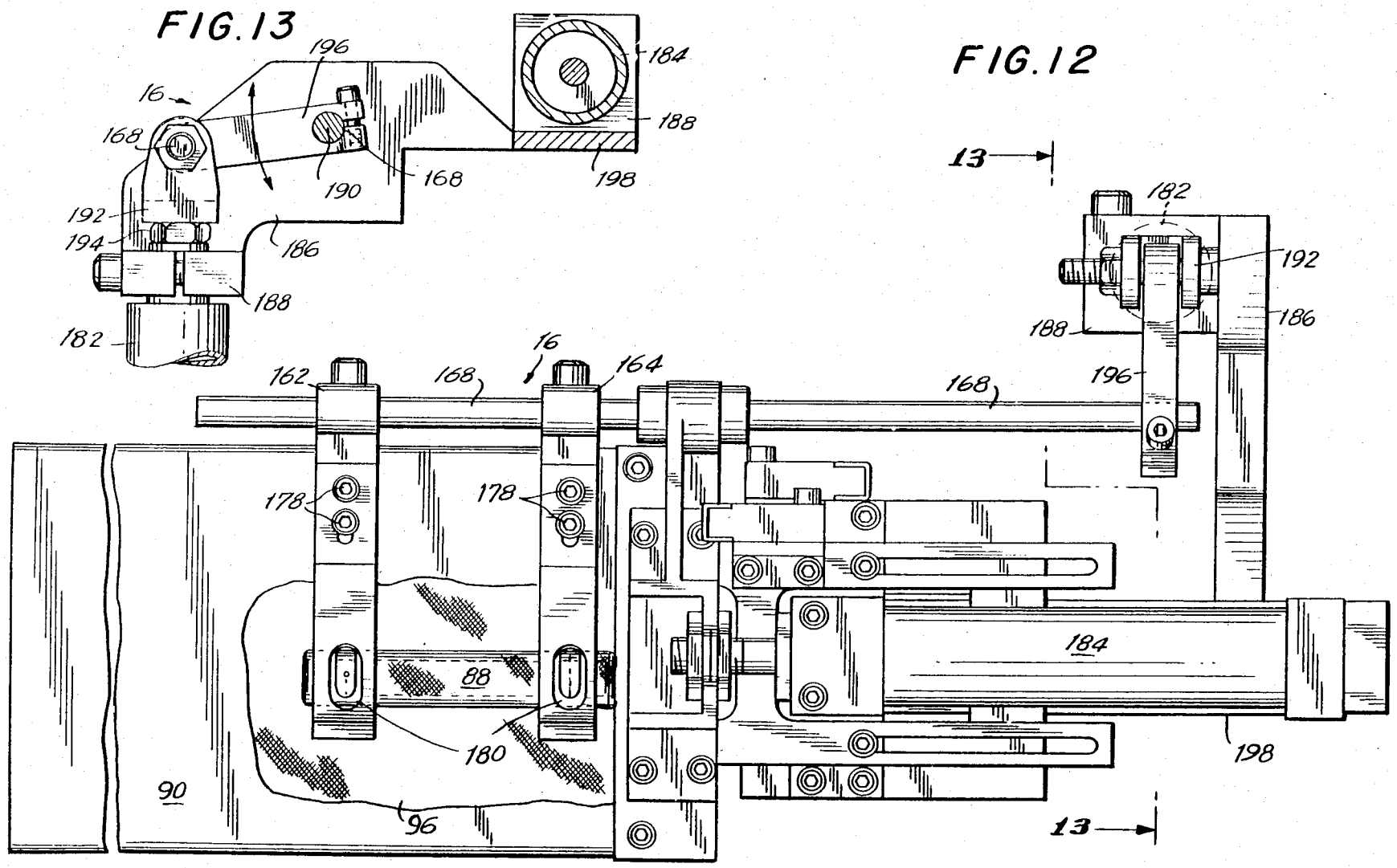
Figure 14:
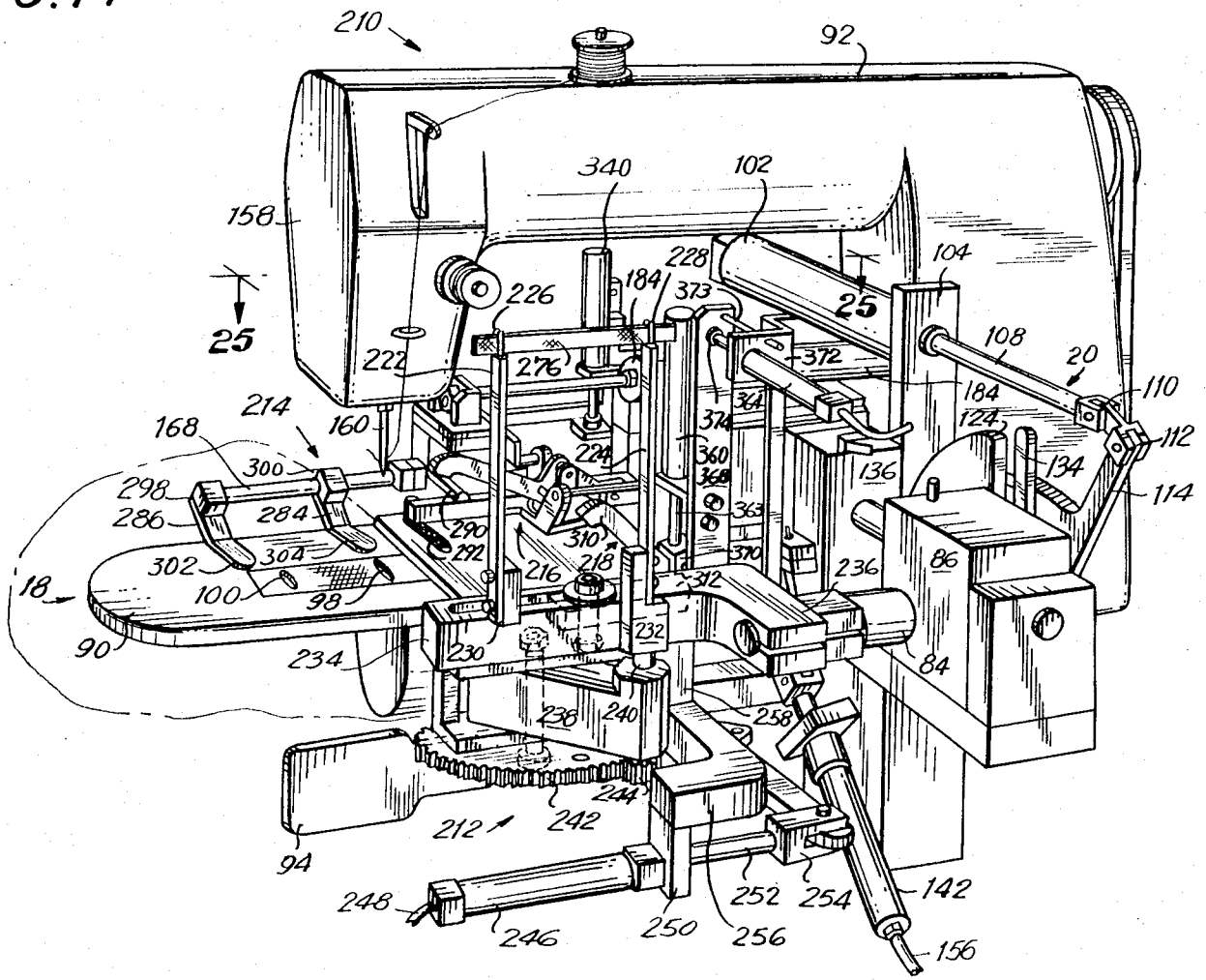
Figure 14A:
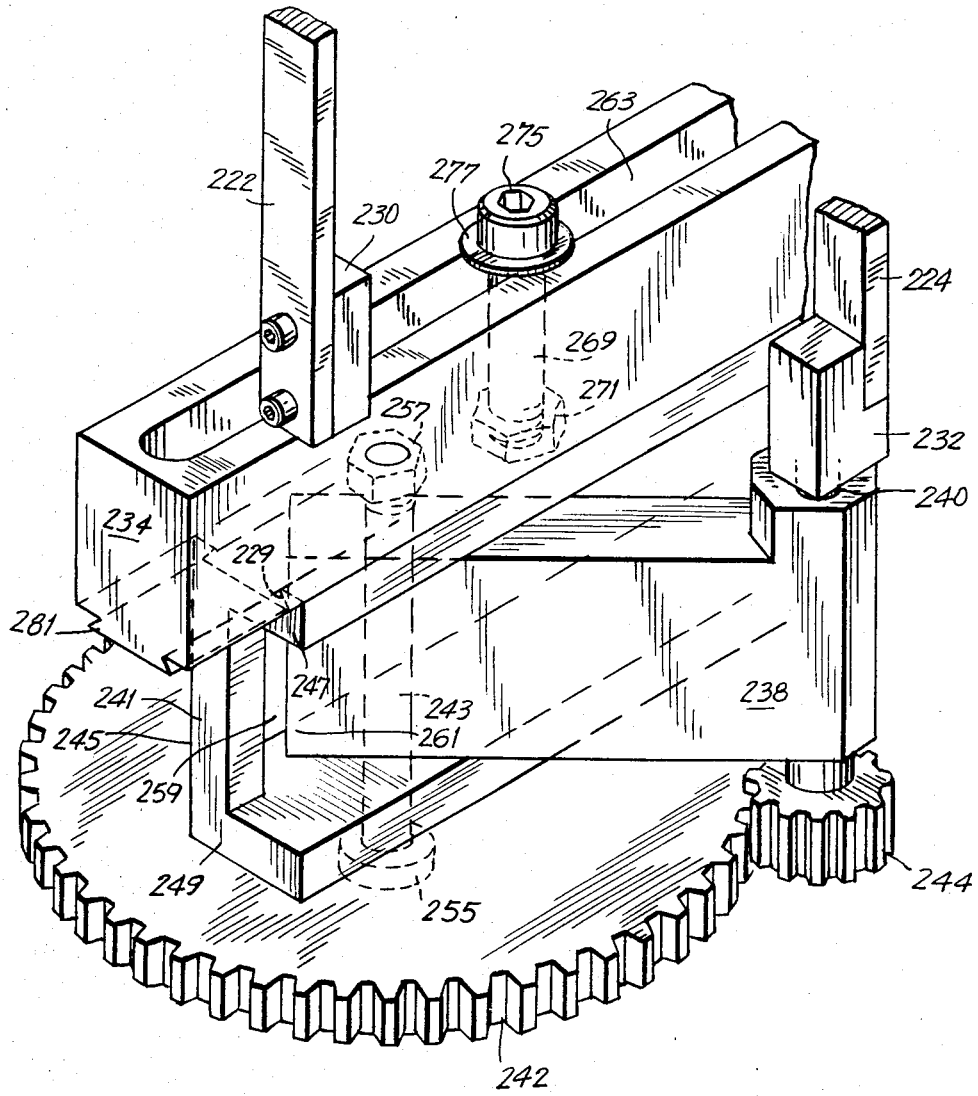
Figure 15:
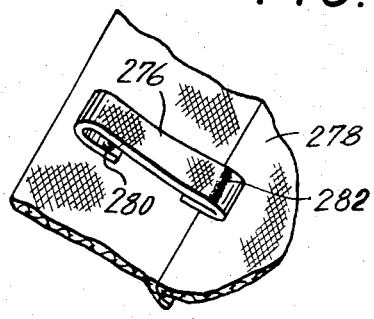
Figure 16:
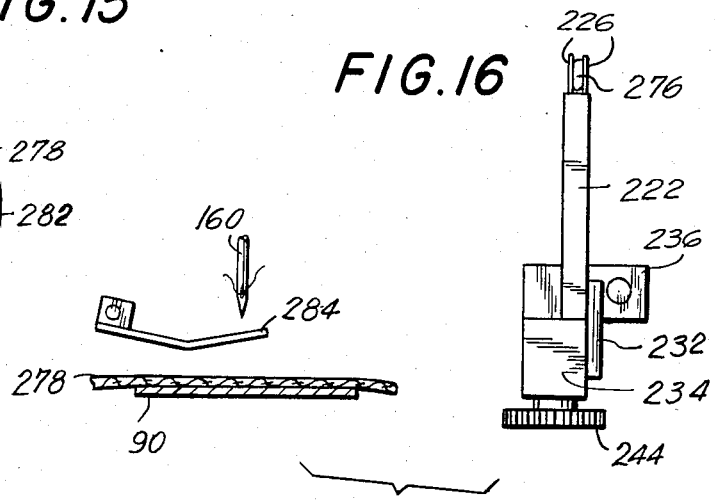
Figure 17:
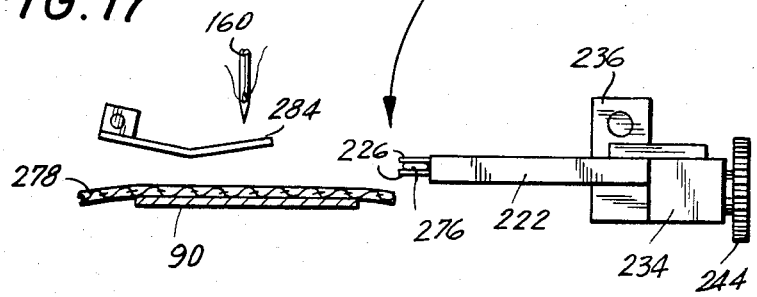
Figure 18:
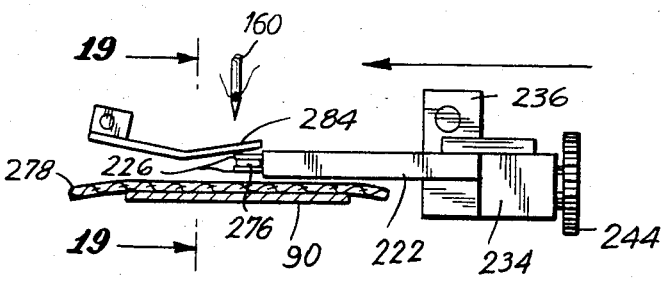
Figure 19:
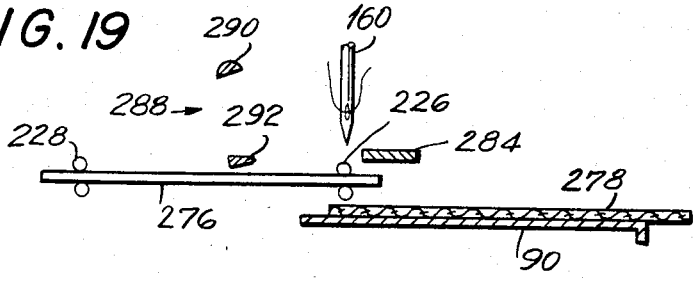
Figure 25:
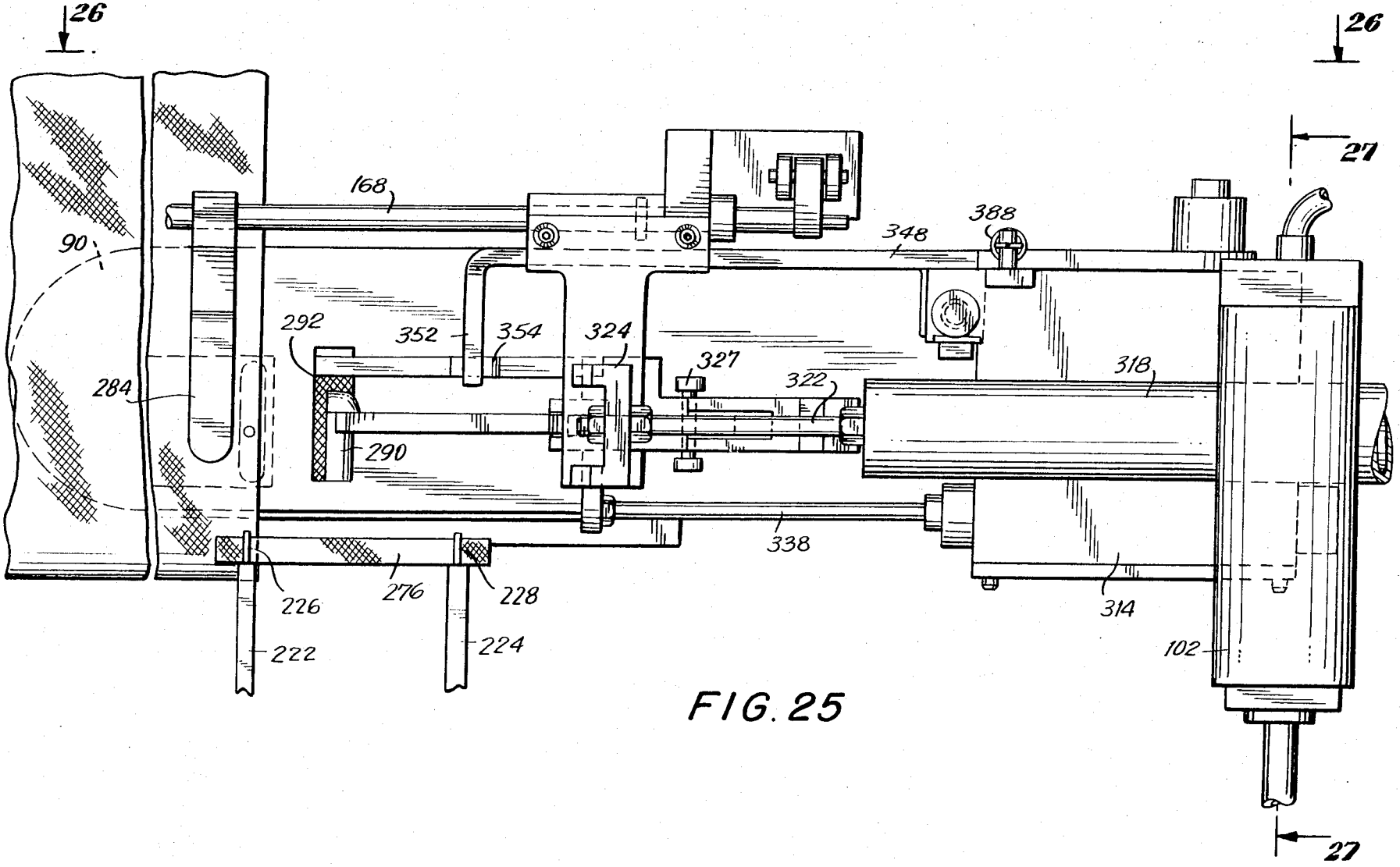
Figure 26:
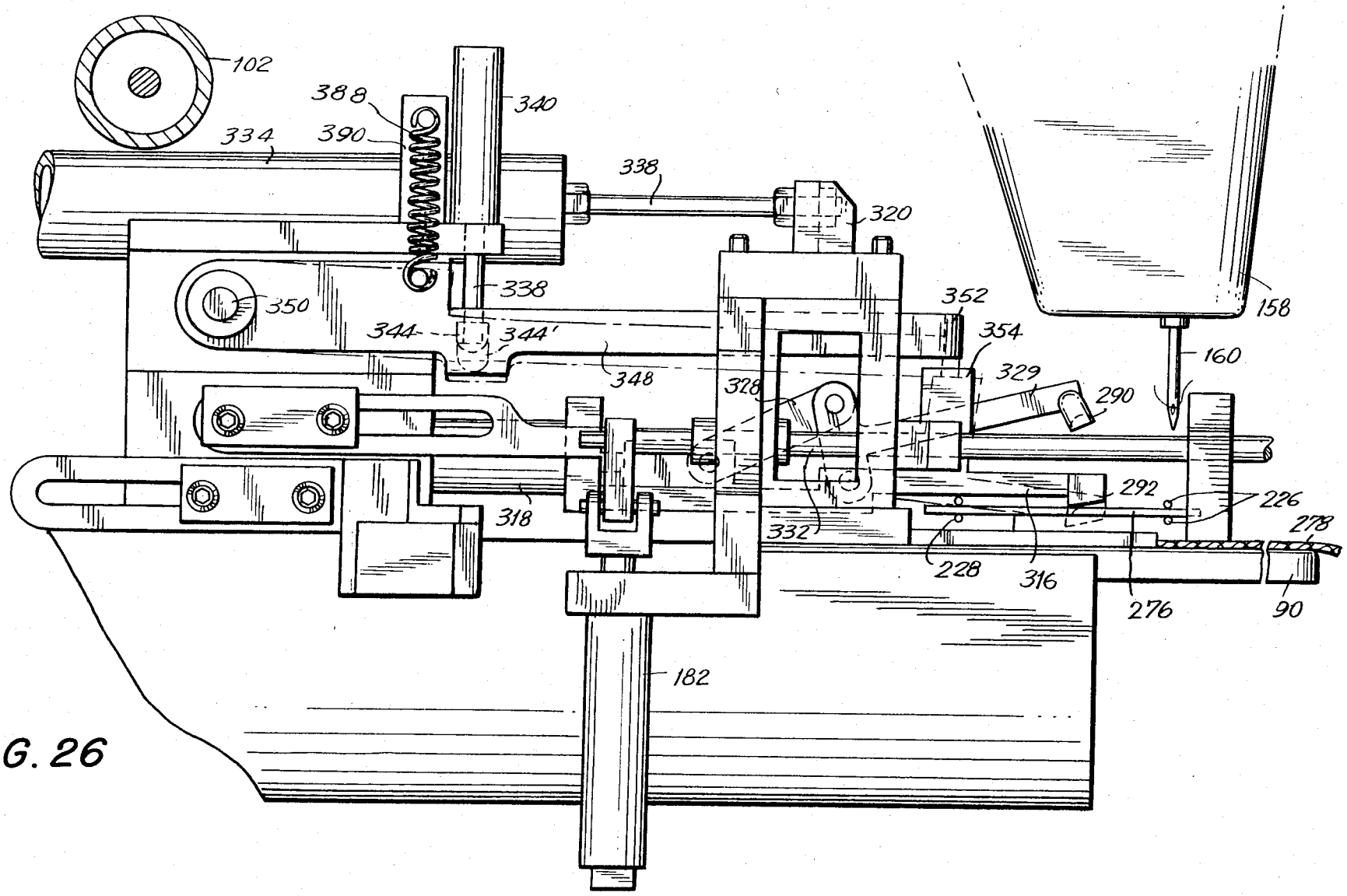
Figure 27:
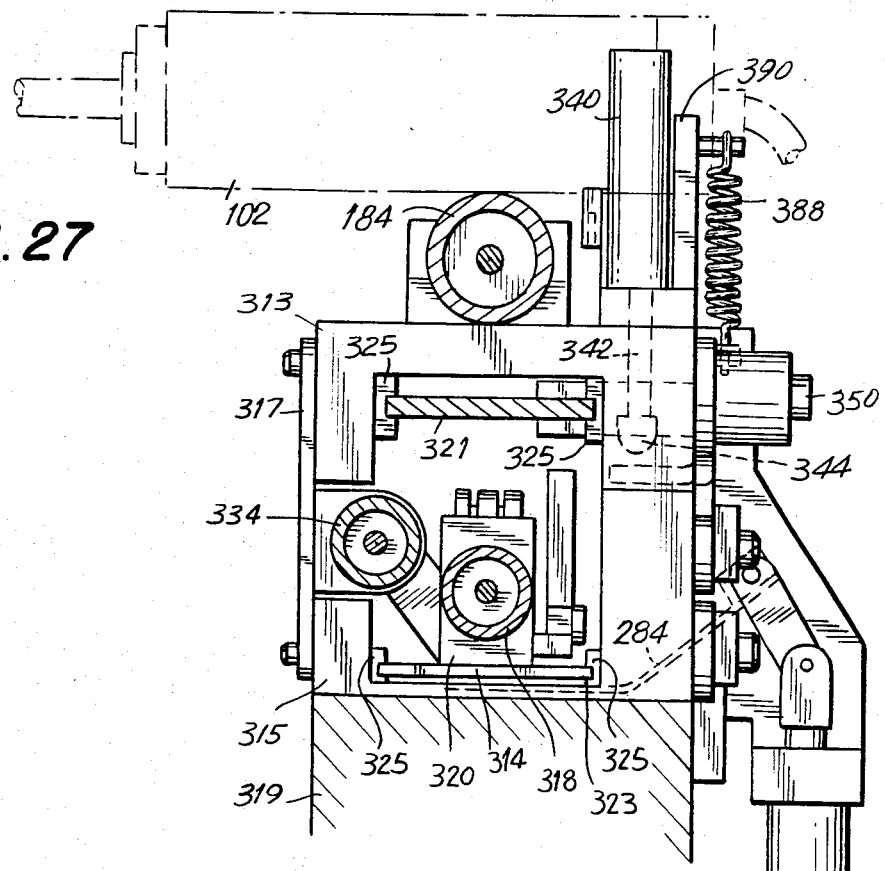
Figure 28:
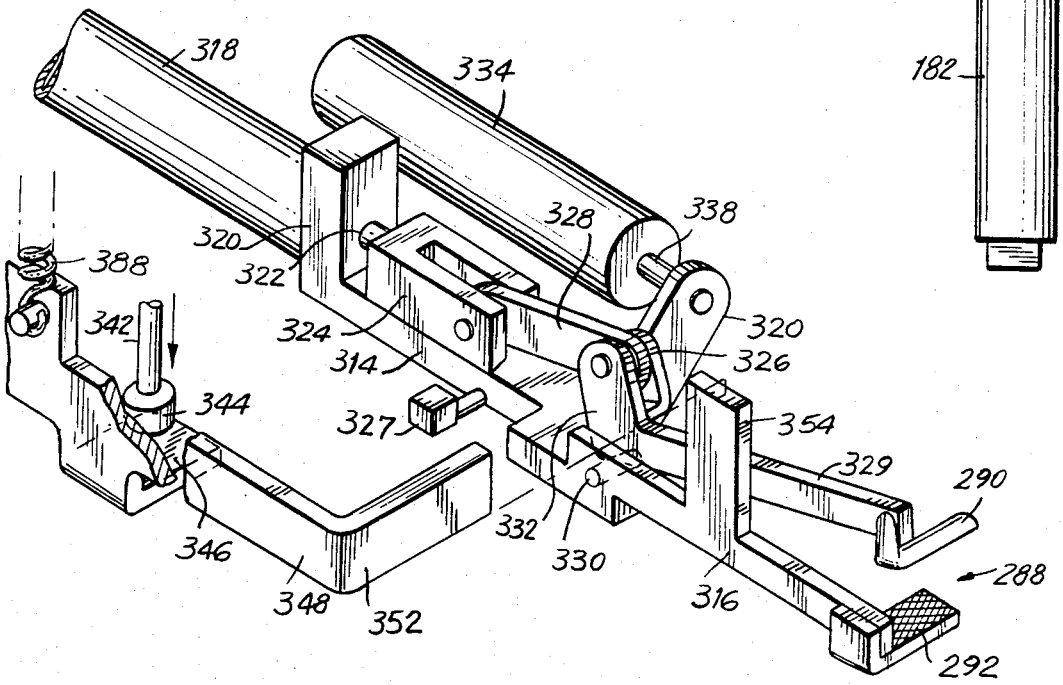
Figures 29, 29A:
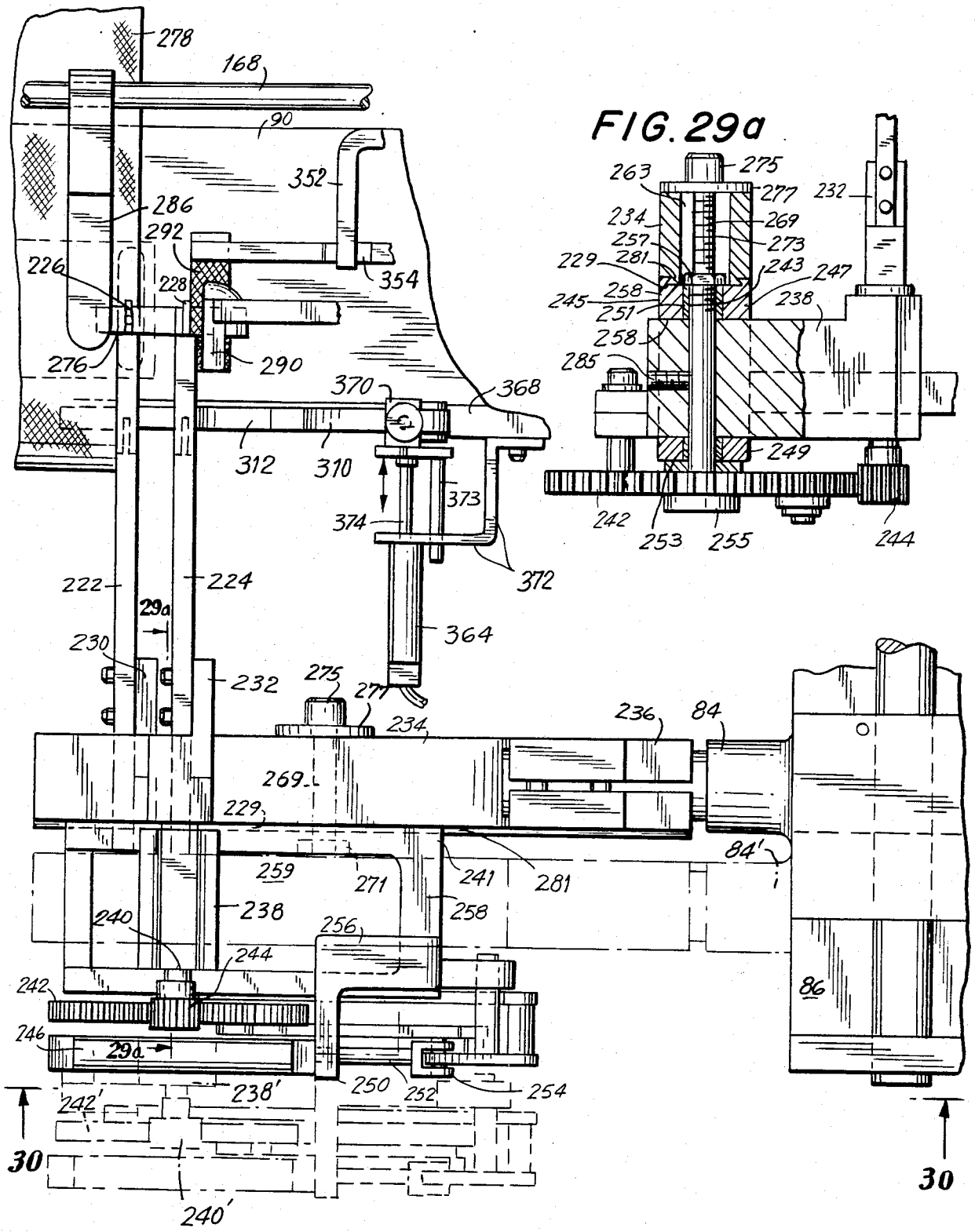
Figure 30:
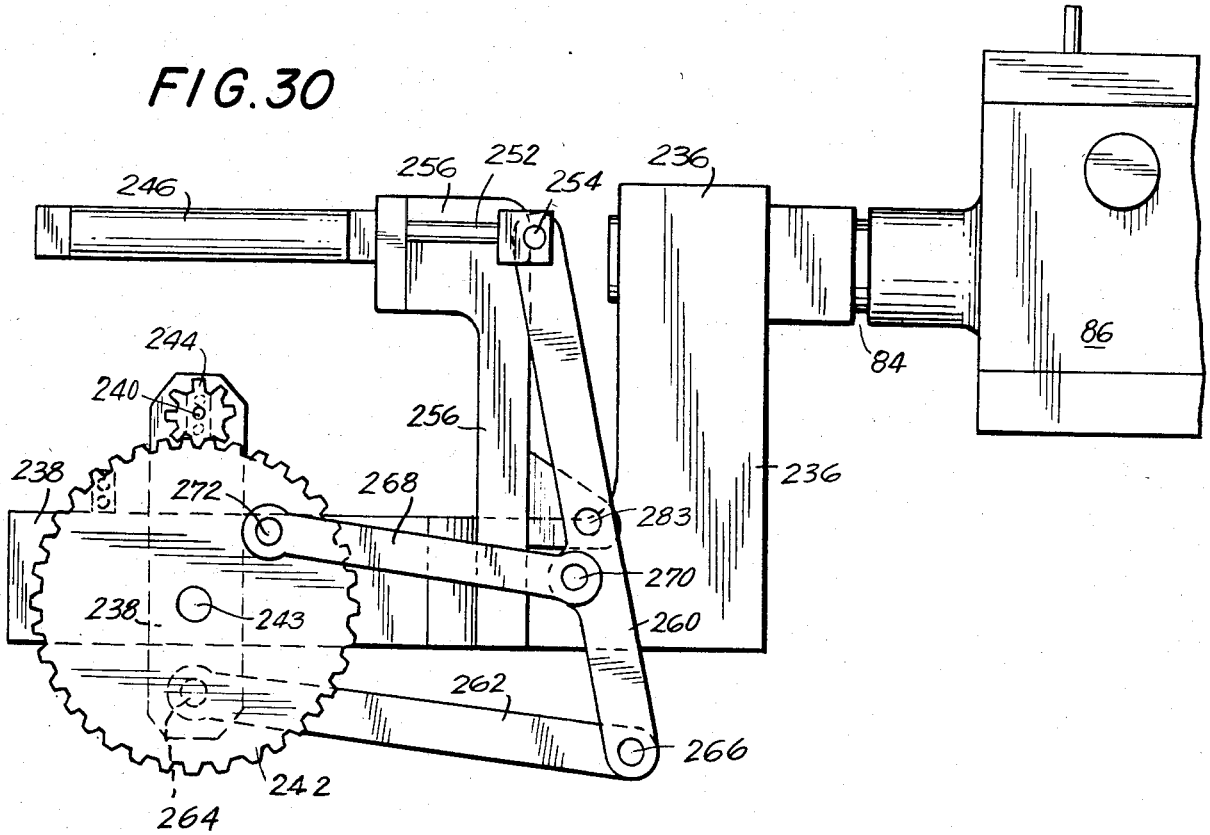
Figure 31:
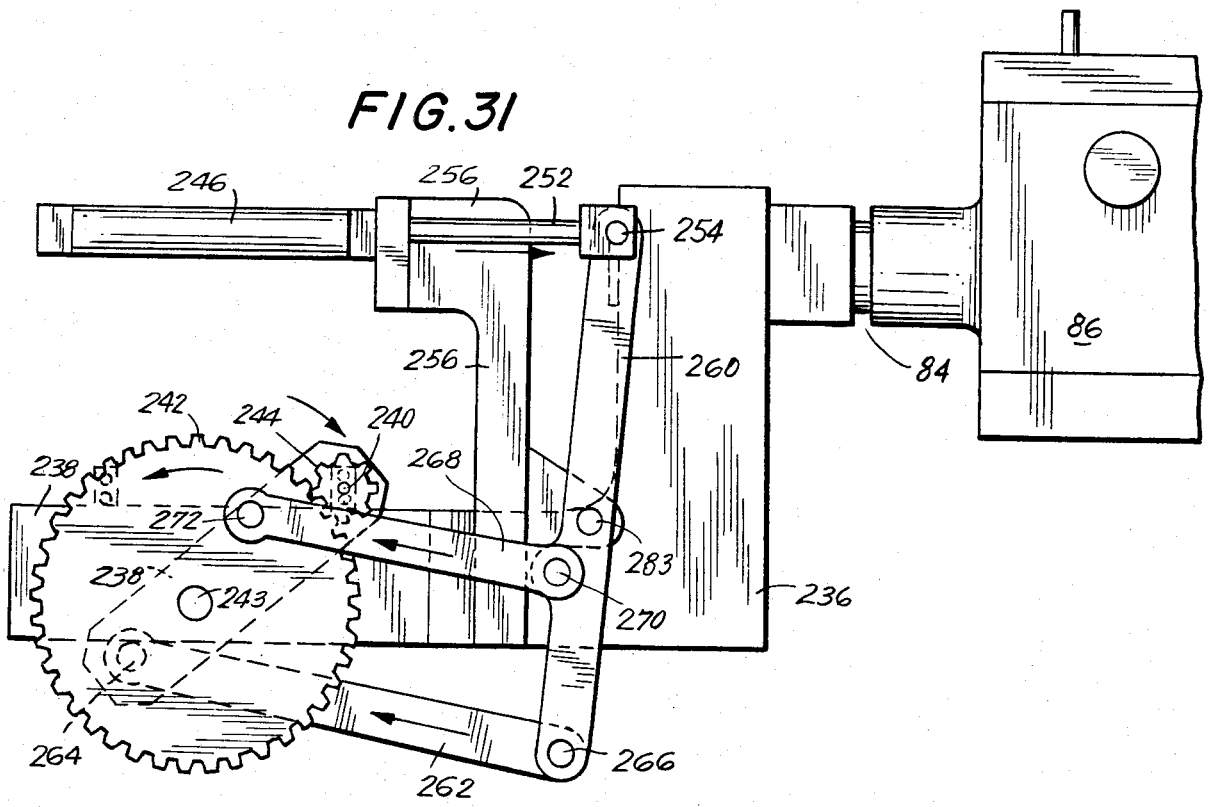
Figure 32:
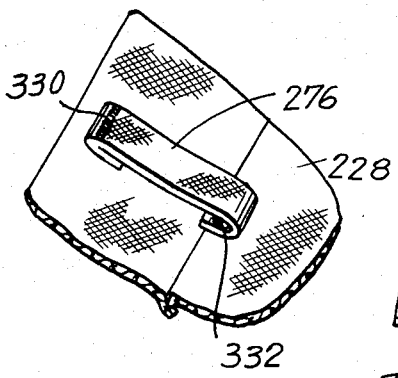
Figure 32:
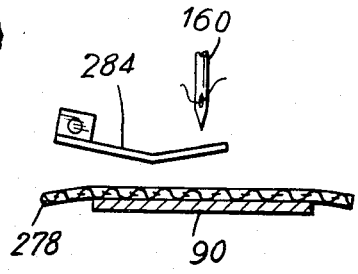
Figure 33:
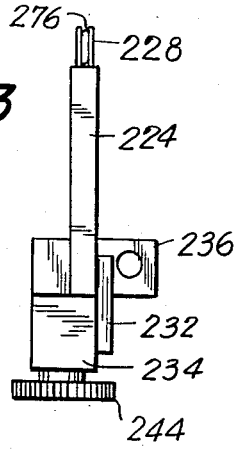
Figure 34:
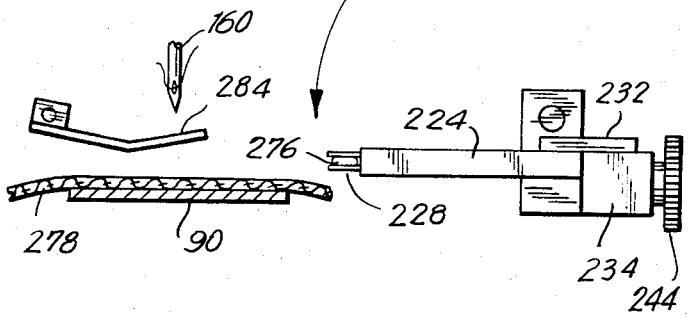
Figure 35:
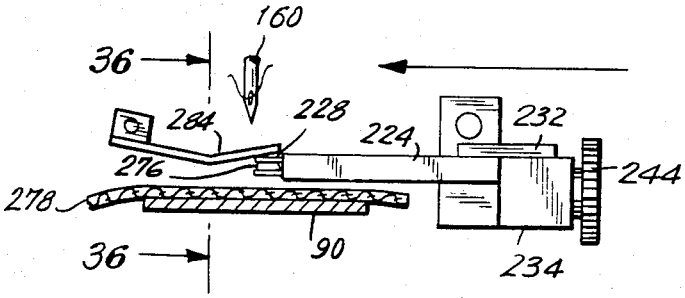
Figure 36:
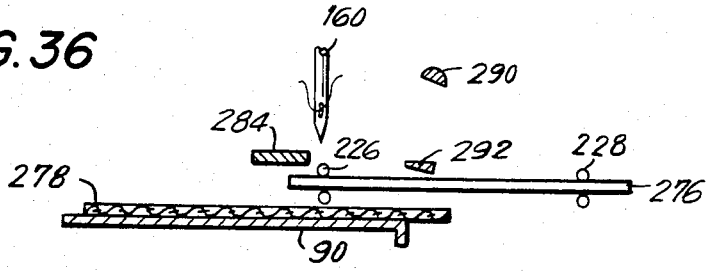

FIG. 5*a* is a view taken along the line 5*a*—5*a* of FIG. 5;

FIG. 6 is a view taken along line 6—6 of FIG. 1;

FIG. 7 is a fragmentary side elevational view of the belt setting system shown in FIG. 1;

FIG. 8 is a view taken along the line 8—8 of FIG. 7;

FIG. 9 is a view taken along the line 9—9 of FIG. 8;

FIG. 10 is a view similar to FIG. 6 during another stage of the sequence of operations to be described below;

FIG. 11 is a view taken along the line 11—11 of FIG. 8;

FIG. 12 is a view taken along the line 12—12 of FIG. 1;

FIG. 13 is a view taken along the line 13—13 of FIG. 12;

FIG. 14 is a fragmentary and partial perspective view of a second embodiment of the system according to the present invention FIG. 14*a* is an enlarged detail of a portion of FIG. 14;

FIG. 15 is a fragmentary perspective view of a belt loop sewn to the pants in the American style in accordance with one aspect of the second embodiment;

FIG. 16 is a simplified schematic-type fragmentary elevational view of both the sewing station at which the clamp is situated as well as the inserter which supports upstanding loop forming fingers in the initial position of the system for tacking in the American style;

FIG. 17 is a view of the station similar to that of FIG. 16 with the inserter rotated downwards to the horizontal;

FIG. 18 is a view of the station similar to that of FIG. 17 with the inserter shifted to a position wherein the loop is beneath the clamp and over the work;

FIG. 19 is a view taken along the line 19—19 of FIG. 18 showing the upper and lower grips and one of the clamps;

FIG. 20 is a view similar to FIG. 19 showing the rotatable finger having rotated its pair of pins with the loop between the upper and lower grips;

FIG. 21 is a view similar to FIG. 20 showing the clamp having been moved downwards pressing the loop against the work and the upper grip having been moved against the lower work and gripping the loop;

FIG. 22 is a view similar to FIG. 21 showing teh loop being sewn to the parts;

FIG. 23 is a view similar to FIG. 22 showing the plate having been moved inwards with the cloth and the grips holding the loop having been moved outwards and also downwards thus positioning the loop against the pants cloth;

FIG. 24 is a view taken through line 24—24 in FIG. 23 showing the extractor having gripped the pants cloth and pulling the pants from the grips after the final sewing operation;

FIG. 25 is a view taken along line 25—25 of FIG. 1;

FIG. 26 is a view taken along line 26—26 of FIG. 25;

FIG. 27 is a view taken along line 27—27 of FIG. 25;

FIG. 28 is a fragmentary perspective view showing elements of the gripping mechanism;

FIG. 29 is a fragmentary plan view showing the two fingers with their pins holding the cloth and the loop forming subassembly of the embodiment shown in FIG. 14 with the fingers having been rotated from the vertical to the horizontal positions and in addition having moved to the inserted position;

FIG. 29*a* is a view taken through line 29*a* in FIG. 29;

FIG. 30 is a view taken along line 30—30 of FIG. 29 with the rotatable finger twirled and down or horizontal;

FIG. 31 is a view similar to the view taken in FIG. 30 except that the rotatable finger has been untwirled and retracted from under the clamp;

FIG. 32 is a fragmentary perspective view of a belt loop sewn to the pants in the European style in accordance with another aspect of the second embodiment shown in FIG. 14;

FIG. 33 is a simplified schematic-type fragmentary elevational view of both the sewing station at which the clamp is situated as well as the inserter which supports upstanding loop forming fingers in the initial position of the system for tacking in the European style;

FIG. 34 is a view of the station similar to that of FIG. 33 with the inserter rotated downwards to the horizontal;

FIG. 35 is a view of the station similar to that of FIG. 34 with the inserter shifted to a position wherein the loop is beneath the clamp and over the work;

FIG. 36 is a view taken through the line 36—36 of FIG. 35 showing the loop over the cloth and under both a clamp and both upper and lower grips;

FIG. 37 is a view similar to FIG. 36 showing the rotatable finger having rotated its pair of pins with the belt loop between the upper and lower grips;

FIG. 38 is a view similar to FIG. 37 showing the clamp having been moved downwards pressing the loop against the cloth work and the upper grip having been moved against the lower work and gripping the loop;

FIG. 39 is a view similar to FIG. 38 showing the loop being sewn to the pants;

FIG. 40 is a view similar to FIG. 39 showing the plate having been moved outwards with the cloth and the grips holding the loop having been moved inwards and also downwards thus positioning the loop against the pants cloth; and FIG. 41 is a view taken through line 41—41 in FIG. 40 showing the extractor having gripped the pants cloth and pulling the pants from the grips after the final sewing operation.

Referring now in more detail to the drawings, we wish to emphasize here that an effort has been made to depict in the drawings a number of components and mechanical parts that are unnecessary to detail here in this specification in order to describe what we believe to be the principal features of the invention. For this reason, an effort will be made to avoid burdening this specification with unnecessary reference characters and unnecessary descriptions that may be more appropriate for a technical manual. However, we wish to emphasize here that a sufficient disclosure and specification shall be set forth so as to enable one skilled in this art to practice the claimed invention.

FIG. 1 is a perspective type of view illustrating an overhead view of portions of the system of the present invention which may be said to include a semi-automatic apparatus and method for folding, positioning and tacking both ends of a belt loop on a trouser waistband, for example. It should be said at the outset that an optional foot pedal allows the operator to bar tack the upper end of a front pocket, as well as to accomplish the other steps that will be set forth. The overall system, designated reference character 10, utilizes pre-cut presewn belt loops which are loaded by the operator while the machine to which the attachment is secured is sewing. This invention contemplates not only provision for an attachment for existing commercial sewing machines, but an entire system which includes the sewing operation and sewing equipment itself, as well.

For the convenience of the reader, this patent specification will describe the apparatus making up system 10 in terms of sub-assemblies which include components that are grouped more from a functional standpoint than from a manufacturing standpoing. Accordingly, a loop-forming sub-assembly 12 cooperates with a clamp or clamping sub-assembly 16, a feed plate/shifter sub-assembly 18 and an inserting mechanism or sub-assembly 20.

The loop-forming sub-assembly 12 comprises an interesting and novel means by which individual pre-cut strips of belt loop material are held, manipulated, and released. More specifically, a pair of finger members or fingers 22 and 24 are shown in FIGS. 1 and 1*a* initially in an upstanding position, and terminating at their respective upper ends in pairs of pins 26 and 28. Each of the pair of pins 26 and 28 are spaced a pre-selected distance from one another, with an elongated slot 30 being formed in the extremity of each of the fingers 22 and 24. The combination of slots 30 and adjusting screws 32 associated with each of the fingers 22 and 24, enable an adjustment of the spacing between each of the pairs of pins associated with each finger.

Fingers 24 and 26 are, respectively, held by conventional type fasteners to posts 34 and 36 which, in turn, are journalled in and supported by finger base members 38 and 40.

Each of finger base members 38 and 40, respectively, supports larger and smaller sprocket wheels 42/44 and 46/48. Sprocket wheels 42 and 44 are cooperatively interconnected by sprocket chain 50, while sprocket wheels 46 and 48 are cooperatively interconnected by sprocket chain 52. The ratio of sprocket wheel diameters is pre-selected for purposes of obtaining desired gear ratios, and chain tension clamp screws 54 facilitate adjustment of tension within sprocket chains 50 and 52.

As perhaps best seen in FIG. 9, rotation of sprocket wheel 46 is induced by means of a drive link 56 through a pin connection 58 at one end of drive link 56, and the opposite end of link 56 terminating in a clevis pin connection 60. Reciprocatory movement of clevis 62 and its clevis pin 60 causes like movement of drive link 56, and is caused by means of logical programmed pneumatic circuitry feeding a twirl cylinder 64 shown in FIG. 9.

A forward end of twirl cylinder 64 is removably held within slotted and adjustable depending support block 66, and is shown in FIGS. 1 and 9 with a portion of its air supply line 68 extending from its rear. A plunger 70 which is integrally connected with the internal piston of twirl cylinder 64 is joined with clevis 62 by means of a lock nut 72.

A sprocket connecting link 74 interconnects larger sprocket wheels 42 and 46 via pin connections 76 and 78 such that, upon retraction of plunger 70 through twirl cylinder 64 from the position of clevis 62 shown in full-line to that of broken or phantom outline shown in FIG. 9, drive link 56 will likewise move, thereby causing rotation of sprocket wheel 46 and comparable rotation of sprocket wheel 42 by means of sprocket connecting link 74. Sprocket chains 50 and 52 transmit this rotary motion to smaller sprocket wheels 44 and 48 such that, through rotation of posts 34 and 36, fingers 22 and 24 are caused to rotate in opposite directions in an articulation about an artificial center of rotation offset with respect to the center line of posts 34 and 36.

As seen in FIGS. 1 and 9, a horizontally extending support bar 76 supports not only block 66 by means of fasteners 78, but also finger base members 38 and 40 by means of rods 80 and 82 at points near its remote end opposite its cylindrical end 84 which, in turn, is supported for rotation via its extension to upstanding rectangular column 86. The functional relationship between the endmost portion of bar end 84 and an insert cam and an insert cylinder is described within this specification at a later point below. Suffice it to say at this point, horizontal support bar 76 is rotatable about the axis of its end 84 such that the entire loop-forming subassembly is thereby caused to rotate about this same axis, independent of the rotation of fingers 22 and 24.

At this point in this patent specification, it is desirable to describe the formation of a belt loop from a strip of belt loop material herein designated by reference character 88, and shown within FIGS. 1, 1*a*, et seq. When the system 10 is in operation, a machine operator places a strip 88 of belt loop material between the pair of pins 26 and 28 such that strip 88 is positioned in the manner shown in FIG. 1. Fingers 22 and 24 will remain in their upstanding, loop-receiving position shown in FIG. 1 until the operational sequence described in more detail below is commenced.

At this point in the specification, it is perhaps best to now describe the actual formation of a belt loop by means of twirling pins 26 and 28. Before doing so, however, it must once again be emphasized here that the apparatus of the present invention does not utilize pins which are caused to rotate about the center of one of the pins, or about a point between the pins. If this is attempted, a relatively large torque is developed because the material being formed must slip with respect to the pins as they twirl, thereby causing a large increase in friction as the material wraps around the pins. In the case of forming a fell or undertuck of belt loop material for positioning and fastening to a pair of trousers, this torque is considerable and will bend the loop-forming pins as well as cause an undesirable binding. This results in pulling the two sets of pins together and, in some cases, will cause actual inelastic bending of these pins.

The present invention by utilizing centers of rotation with respect to the pairs of pins 26 and 28 shown in FIGS. *2a*, *2b* and *3a*, overcomes these limitations by actually facilitating the formation of a belt loop from a strip of pre-cut belt loop material, without slipping of the material with respect to the pairs of pins being at all necessary. In fact, according to the present invention, a slack is created in the belt loop strip and only after the fell or undertucking is created is the material extending between the pairs of pins brought to a taut condition.

Referring now in more detail to the drawings, FIGS. *2a*, *2b* and *3a* illustrate, respectively, the beginning, and intermediary point, and the completion of the pin twirling and loop-forming sequence that is accomplished just prior to the sewing of the completed loop to trouser material, as an example, as best illustrated in fragmentary sectional view FIG. *5a*. In FIG. *2a*, it can be seen that the pairs of pins 26 and 28 move in opposite fashion such that the right and left sides of FIGS. *2a*, *2b* and *3a* are substantially mirror images of the opposite sides. Center lines have been used within these views not only to illustrate the fact that the center of rotation of each pair of pins is offset from the pins themselves and any point between them, but also to give the reader a better understanding of the positioning of the pins with respect to these centers of rotation when the belt loop material is in the configurations shown at each of these steps during the approximate 270° angle of rotation of the pins about their artificial centers.

In FIG. *2a*, pins 26 and 28 are shown with their mid point at approximately nine o'clock and three o'clock, respectively, at a time when the belt loop material 88 is inserted between the pins. Upon actuation of twirl cylinder 64 described above, rotation of fingers 22 and 24 result in their respective pairs of pins 26 and 28 rotating oppositely with respect to one another and toward one another to create a slack in belt loop material 88 (FIG. *2b*) while the fell or tuck is being formed. Continued rotation of the pairs of pins 26 and 28 about their centers culminates in the tuck being formed (FIG. *3a*), and with the material 88 being drawn to a substantially taut condition, and wherein one of each of the pairs of pins 26 and 28 comes to rest at a substantially tangential twelve o'clock position with respect to its artificial center of rotation.

In a preferred embodiment of the present invention, the twirling and folding of the belt loop material into belt loop form is accomplished during rotation of the loop-forming sub-assembly 12 and the insertion of the formed belt loop into its sewing position on trousers 96 which have been positioned on top of a feed plate 90 (FIG. 1).

Means are provided for adjustment not only of the offset of the pairs of pins 26 and 28 with respect to their centers of rotation, but also the magnitude of the angle of rotation. This enables the user to accomodate different thicknesses of belt loop material and enables the user to accomplish different kinds and types of bend configurations, if desired, The type of bend illustrated in the drawings represents a preferred embodiment.

Mention has been made of a feed plate 90. At this point we wish to affirm that the present invention comprising the system 10 herein described contemplates a system wherein a sewing machine and its associated components are provides, as well as an attachment system capable of being fitted on and to an existing sewing machine purchased separately from the present invention. However, the novel advance provided by the present invention is such that we believe our protection and any possible royalty income should contemplate in some instances the value of the entire system and sewing machine and apparatus when making computations. One of the reasons for this position resides in our belief that conventional or known sewing machines and apparatus are unable to provide the benefits herein described for the present invention.

FIG. 1 illustrates a sewing machine 92 of a basic structural type available from manufacturers such as Singer and Union Special. A suitable starting paddle 94 or lever or, for that matter, a foot pedal/chain arrangement, may be used by the operator to start the inventive sequence.

When the procedure is complete, a folded and tucked belt loop will have been sewn to the top of a pair of trousers or trouser material 96, as an example (FIG. 1), which have been positioned by the operator on top of feed plate 90 which includes a pair of needle clearance slots or holes 98 and 100, which are formed through the feed plate.

In operation, the present invention not only provides the formation of a belt loop, as described above, but also provides reliable and repeated positioning of belt loop material in a position to be sewn. This is accomplished with the cooperative help of inserting sub-assembly 20.

Referring now to FIG. 6, which illustrates system 10 in a loading position, wherein material 88 is shown in phantom outline prior to loading and in loaded position between the pins of fingers 22 and 24 (finger 24 obstructs the view of finger 22 in FIG. 6), a pneumatic insert cylinder 10 is shown (see also FIG. 1) with its operative end held and positioned by means of upstanding support block 104. Insert cylinder 102 is operatively connected by means of its air line 106 to the pneumatic circuitry referred to for twirl cylinder 64 above. An associated plunger member 108 which is integrally connected to or may form part of an internal piston (not shonw) associated with insert cylinder 102 extends outwardly from cylinder 102 and support block 104 toward and to a clevis linkage arrangement comprising clevis members 110 and 112 which, via pin connections, link arm 114 of lever 116 with plunger 108. A lock nut 118 removably secures this connection.

A connecting link 120 interconnects arm 122 of lever 116 via pin-type connections with an insert cam 124. Insert cam 124, like lever 116 at journal point 126, is supported for rotation with respect to column 86 at journal point 128. Cam 124 includes an arcuate cam bearing surface 130 which basically comprises a radius about journal point 128, and an elongated substantially radial slot 132 bounded at its leftmost side as shown in FIG. 6 by finger portion 134.

Support column 136, which is stationary supports a cam roller follower 138 shown in FIGS. 6, 7, 8 and 10. The outer cylindrical surfaces of cam roller follower 138 engage arcuate cam bearing surface 130 of insert cam 124. Slot 132 is of dimensions that enable the entry therein of cam roller follower 138 and engagement of the outer surfaces of follower 138 with the surfaces which define slot 132, as will be seen below.

A linkage arrangement interconnects follower 138 with the plunger 140 of a duck cylinder 142. The operative end of duck cylinder 142 is supported by means of support block 144, which is positioned by means of fasteners 146 to the base of column 136. Clevises 148 and 150 are interconnected by a connecting link 152, thereby causing cooperation between roller follower 138 and the lock nut 154 end of plunger 140 associated with duck cylinder 142.

Duck cylinder 142, like insert cylinder 102 and twirl cylinder 64, is interconnected by means of air line 156 to the pneumatic circuitry associated with system 10.

In operation, the inserting sub-assembly 20 cooperates with the loop-forming sub-assembly 12 as follows. Referring to FIGS. 6, 7 and 10 in particular, insert cylinder 102 is actuated such that its associated plunger 108 is drawn toward the cylinder. This results in a forceful pivoting of lever 116 through its arm 114 and the linkage involving clevises 110 and 112 revolving about pivot or journal point 126. This, in turn, results in rotation of insert cam 124 about its pivot or journal point 128 as a result of the forceful eccentric urging through arm 122, rotates from the position shown in FIG. 6 to the intermediary position shown in FIG. 7, with cam roller follower 138 following the cam surface 130 of cam 124 during this rotation in a clockwise direction.

Once cam 124 has reached the substantially 90° from that shown in FIG. 6, the interfering following cam surface presence of surface 130 no longer inhibits or interferes with movement of the cam 124 in the general direction (forward) of cylinder 102. Upon further urging of plunger 108, cam 124 advances such that cam roller follower 138 enters slot 132 and advances until the sub-assembly assumes the position best seen in FIG. 10, wherein plunger 108 is substantially fully retracted.

Figure 2:
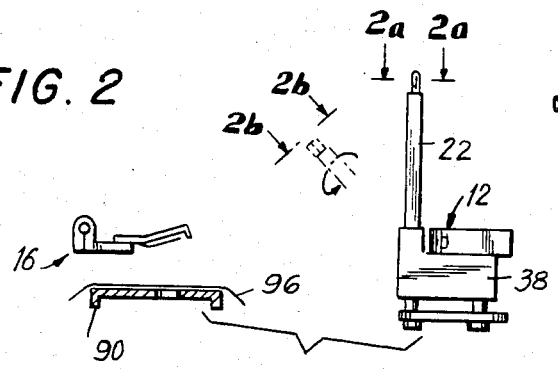
Figure 2A:
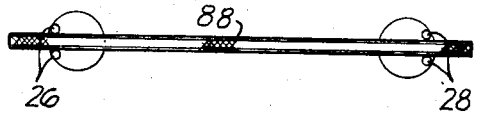
Figure 2B:
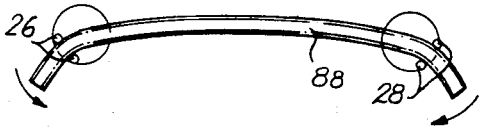
Figure 3:
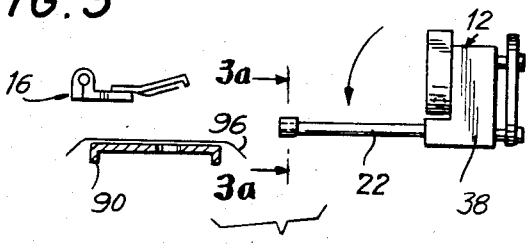
Figure 3A:
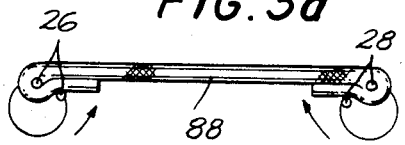
Figure 4:
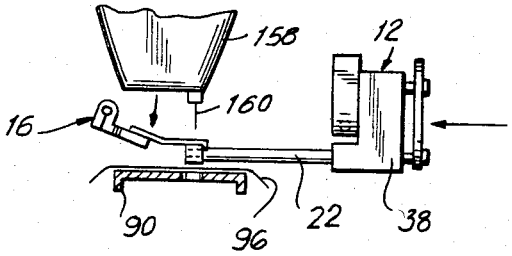
FIG. 4 is a view of the station similar to that of FIGS. 2 and 3, but where the inserter has advanced the forming fingers to a position beneath the stripper/clamp and over the work.

This sequence of operation of inserting sub-assembly 120 accomplishes the function of rotating the loop-forming sub-assembly 112 from the position shown in full-line in FIG. 2 first to the intermediary position shown in phantom or broken lines shown in FIG. 2 and thereafter to the position shown in FIG. 3, wherein the fingers 22 and 24 that are holding the belt loop that has been formed during this sequence are substantially horizontal and at an elevation slightly above that of the trouser material to which the belt loop is to be sewn. Thereafter the fingers are advanced over the trouser material and, upon actuation of duck cylinder 142 and through the linkage described, the loop is dropped while being held such that it is correctly positioned in contact with the trouser material. This is best seen in FIG. 4.

For a better understanding of the relative positions of these components, FIG. 2 illustrates the loop-forming sub-assembly in a position corresponding to the apparatus position illustrated in FIG. 6. FIG. 3 illustrates this apparatus in the position corresponding to that shown in FIG. 7, wherein it will now be appreciated that cam 124 is integral with the loop-forming sub-assembly 12 such that its rotation results in rotation of sub-assembly 12. FIG. 4, which illustrates the advancing of loop-forming sub-assembly 12 in the direction of the sewing head 158 of sewing machine 92 and its needle 160 corresponds to the positioning illustrated within FIG. 10.

Before going on to describe the clamping, sewing, and shifting mechanisms, the sequence of operation of the inserting sub-assembly 20 just described, once the clamping, sewing and shifting is accomplished, is simply reversed by means of the pneumatic circuitry logic that has been preprogrammed. This is best illustrated within the right portion of FIG. 5 of the drawings.

Having just described the means by which the belt loop strip material has been formed into a loop by means of loopforming sub-assembly 12, and having described the means by which this loop is rotated from the position at which it has been inserted between the pins of fingers 22 and 24 to the sewing position, we turn now to the means by which the belt loop is clamped and held reliably in the sewing position as well as the means by which the material being held is shifted between the two positions or stations at which sewing of the belt loop to the trouser material occurs.

As best seen in FIG. 1 and top plan view 12, clamp or clamping sub-assembly 16 includes a pair of movable clamp holders 162 and 164 which are positioned on and supported by a horizontally extending support rod 168. Clamp holders 162 and 164, respectively, support outer clamps 170 and 172 as well as clamp leaf springs 174 and 176 situated in spaced relationship beneath each outer clamp 170 and 172. These outer clamps 170 and 172, as well as the leaf springs 174 and 176 are secured to the clamp holders 162 and 164 by means of cap screws 178. Needle clearance holes 180 are formed through each of the outer clamps 170 and 172.

A clamping cylinder 182 of the pneumatic type and tied to the same pneumatic programmed circuitry already described for twirl cylinder 64, insert cylinder 102, duck cylinder and soon to be described shift cylinder 184, is vertically positioned and held by means of an angled bracket 186 formed with clamping boss 188. The support rod 168 is caused to be pivoted about point 190 by means of cylinder 182 through a linkage made up of clevis 192 to which the plunger (not shown) associated with clamp cylinder 182 is secured by means of lock nut 194, and a link member 196. This is best seen in enlarged elevation view FIG. 13.

The same bracket 186 whose boss 188 holds clamping cylinder 182 is formed with a substantially horizontal shelf portion 198. As seen in FIGS. 1 and 13, this shelf 198 supports shift cylinder 184 which is situated horizontally with respect to system 10. A plunger 200 is associated with shift cylinder 184 in much the same manner as has been described for plunger 108 associated with insert cylinder 102. Feed plate 90 is secured to the end of plunger 200 through a bracket 202 and fastening means 204. Feed plate 90 is supported for sliding movement over guide support rail 206. Further guiding is accomplished by means of sleeve 208 slidably supported upon support rod 168.

In operation, clamp sub-assembly 16 operates as follows. Actuation of clamp cylinder 182 results in a lowering of support rod 168 and thus clamps 170 and 172 with their associated leaf springs 174 and 176. This results in a clamping or holding of the formed belt loop 88 to and in contact with the trouser material 96. This position may be seen in FIG. 4. At this point the sewing head operates such that the sewing needle is able to pierce and tack or sew the upper connection of the belt loop 88 to the trousers. After the sewing or tacking of this upper tack is completed and the needle 160 retracted, shift cylinder 184 is actuated such that its plunger 200 is retracted, thereby drawing feed plate 90 and the clamped material and trouser material toward cylinder 184 until needle clearance hole 100 lies beneath needle 160. Thereupon, the second sewing operation is accomplished and the needle retracted.

To summarize again, loop-forming sub-assembly 12 receives belt loop material 88, forms this material into a belt loop and holds it in this position ready for sewing. Inserting sub-assembly 20 rotates loop-forming sub-assembly 12 and draws it horizontally and then downwardly over the trousers to the sewing position at which the belt loop material 88 is to be secured by two tacks to the trouser material. Clamp sub-assembly 16 draws the formed belt loop and holds it against the trouser material at all times during the sewing operation. The shifting sub-assembly 18 utilizing shift cylinder 184 moves the feed plate and the entire clamped sub-assembly 16 between two sewing stations.

After the sewing is accomplished, all of these sub-assemblies return to their initial positions in order to receive another strip of belt loop material and in order to accomplish on a repetitive basis the same sequence of operations. This is at least partially illustrated in the case of loop-forming sub-assembly 12 within FIG. 5.

The system 10 which is commercially referred to as a belt loop setter, now according to the present invention provides a new and automated approach to fastening belt loops to jeans and leisure trousers. The most time-consuming part of the operation is automated, and efficient reliable repeatability is accomplished. Essential features of system 10 include a 3.2 second loop attachment cycle, including the folding, placement and the two tacks; the provision of relatively unskilled labor requirements in order to operate the system; automatic folding, positioning and tacking of the ends of each loop; minimum holdunder for neat appearance after washing; the use of pre-cut loops, thereby enabling retention of shade matching control; and installation of seven loops in less than one minute, inclusive of trouser positioning and loading. The system provides all of these features with all-pneumatic logic and operation, with high reliability components, low air consumption, and no electronics.

This system further provides a training cycle, a normal cycle, and an optional auxiliary clamping cycle. Adjustability of virtually all sub-assemblies and components is provided.

Other options that will be briefly touched upon here include a training cycle, whereupon an inexperienced operator is able to stop the operation of system 10 at any point before sewing begins, so that errors in positioning the waistband of the trouser material or errors in placing the loop in the twirl pins can be corrected. When the training mode switch (not specifically described here) is in the "train" position, the cycle is the same as normal operation except that the start paddle 94 will be held in the operated position until sewing starts. When sewing begins, the cycle continues automatically to the end. If the start paddle is released at any point before sewing starts, the machine will return to the start position. The training cycle can be used as an alternate to the normal cycle permanently if desired.

A special tack option is provided with the present invention, whereupon the operator positions the top of a pocket under the outer clamp and depresses the foot switch. The clamps come down, the feed plate shifts to the second tack position and sewing begins. When the tack is complete, the feed plate shifts out and the clamps lift. There is no belt loop insertion when the foot pedal is used. The special tack may be operated at any time between the normal belt loop cycles.

Another option includes a "clamp down" switch, whereupon the clamp down switch lowers the clamps to facilitate needle threading and certain adjustments. When this switch is operated, the air is removed from the rest of the mechanism and the mechanism can be operated manually.

Another option provided includes a sew test button which will cause a sew cycle if it is pressed when the "clamp down" switch is operated. This allows the sewing machine to be checked without going through a complete loop setting cycle.

Another option includes a loop tack repair, such as in the case where if the upper tack is unsatisfactory, the loop should be cut off and replaced. If the lower tack is unsatisfactory or missed because of thread break of bobbin runout, it can be repaired in place if the machine is equipped with a special tack option. By removing the partial tack if necessary, the user folds the loop manually under the clamp. The clamp is then pushed down with the left hand and the special tack foot pedal is pressed. When the feed plate begins to shift, the left hand is removed from the clamp which is now under power operation.

It must again be emphasized here that the user of system 10 is able to alter loop lengths, loop tension and loop thicknesses. More specifically, to change the loop length, a different feed plate 90 with sewing openings that correspond to the distance between the tacks is substituted for the prior plate. The new plate is fastened with two screws at its inner end. The form fingers 22 and 24 are adjusted to correspond to the sewing slots. The pins are adjusted such that the center distance is the same as the sewing slot spacing, while maintaining the pin attitude. The tilt of the pin assemblies is usually about the same.

In the case of altering the loop tension, this is accomplished by adjusting the stroke of the twirl cylinder 64. To reduce tension, the piston rod or plunger lock nut is manipulated. In the case of differing loop thicknesses, the twirl pin spacing is adjusted with screws 32.

The above-described embodiment of the present invention as exemplified in FIG. 1 accomplishes the task of sewing a belt loop onto pants cloth with the final result indicated in FIG. 5*a*. It is apparent in FIG. 5*a* that both tacks, that is the upper trak and the lower tack would be visible. This visibility is not considered aesthetic, however, and it is desirable at times to hide either the top tack or the bottom tack. The style of the top tack being hidden is called the American style; and that of the bottom tack being hidden is called the European style. These terms will be used as terms of art in this disclosure. The American style tack is illustrated in FIG. 15, and the European style tack is illustrated in FIG. 32.

A variation, or second embodiment, of the present invention that accomplishes the task of sewing a belt loop onto a pair of pants in either the American or European style as desired is shown in a partial perspective view in FIG. 14 with the overall system of this second embodiment designated reference character 210.

In the manner used for system 10, the apparatus of system 210 will be described in terms of sub-assemblies that are grouped from a functional standpoint.

Two of the sub-assemblies described in relation to system 10 remain the same in all respects for system 210, namely, feed plate/shifter sub-assembly 18 and inserting mechanism sub-assembly 20. Certain reference numerals will remain the same for systems 10 and 210 and as such are so designated on FIG. 14, especially with regard to sub-assemblies 18 and 20, and will not be specifically called out here in each and every element except for purposes of clarity during the description herein. In addition, FIG. 14 illustrates the same type of sewing machine 92 as described for system 10, including sewing head 158 of sewing machine 92 and its needle 160.

Overall, system 210 includes, besides the mentioned sub-assemblies 18 and 20, a loop-forming sub-assembly 212 that cooperates with a clamp sub-assembly 214, a gripping sub-assembly 216, and an extractor sub-assembly 218. In fact, clamp sub-assembly 214 is operated by a mechanism identical to sub-assembly 16 of system 10, but because the clamp details of sub-assembly 16 differ from those of system 210, a short separate description of clamp sub-assembly 214 will be made.

It is noted that although sub-assemblies 18 and 20 of systems 20 and 210 are identical in construction and arrangement, the sequence of their operations are different for the two systems and the pneumatic programmed circuitry will differ for each system. This reservation is likewise applicable for clamp sub-assembly 214.

FIG. 1 illustrates a pair of finger inserter members, or fingers, 222 and 224, which are in fact identical to fingers 22 and 24 of FIG. 1. Fingers 222 and 224 are shown in an upstanding position. They terminate at their respective upper ends in pairs of pins 226 and 228, which are again identical to pins 26 and 28 of FIG. 1. Fingers 222 and 224 are held by conventional type fasteners to posts $23^0$ and $23^2$ respectively. It is at this point that the first departure is made from the construction and arrangement of the loop-forming sub-assembly 12 of FIG. 1.

In FIG. 14 posts 230 and 232 are both connected to loop-forming sub-assembly 212, which in turn cooperates with inserting sub-assembly 20. Post 230, however, is connected by conventional means to a horizontal support bar 234, which is rotatable about the axis of pivot 84 in turn pivotably connected to an L-bend 236 of support bar 234. Pivot 84 connects support bar 234 of sub-assembly 212 to sub-assembly 20 in the same manner as pivot 84 connects support bar 76 of sub-assembly 12 of FIG. 1 to sub-assembly 20 in the first embodiment. Sub-assembly 20 in FIG. 14 cooperates with sub-assembly 212 in a manner to be described. The apparatus of sub-assembly 20 is mounted with stationary upstanding rectangular column 86 through which the opposite end of pivot 84 is rotatably connected. The functional relationship between the endmost portion of pivot 84 and insert cam 124 and insert cylinder 102 have been fully described above in relation to the first embodiment of FIG. 1. At this point, it is sufficient to say that the entire loop-forming sub-assembly 212 is caused to rotate about the axix of pivot 84 independent of any rotational movement of fingers 222 and 224.

Loop-forming sub-assembly 212 further includes duck cylinder 142 as shown in FIG. 14 and as also indicated in FIG. 1. Plunger 140 is duck cylinder 142 is interconnected to the linkage arrangement described above in relation to FIG. 1 which in turn is, as also described formerly, positioned by fasteners to the base of column 136. Duck cylinder 142 is connected to the common pneumatic power source described in relation to the first embodiment via air supply line 156.

Finger 224, along with its associated pair of pins 228 and post 232, is distinguished from its paired finger 222, along with its associated pair of pins 226 and post 230, by way of finger 224 being rotatable, and not only rotatable, but doubly rotatable, that is, rotatable in two different ways. Finger 224 will from hereon be designated as rotatable finger 224. Rotatable finger 224 is affixed to one end of support block 238 at the bottom of post 232 at pivot 240.

Support block 238 is rotatably mounted to a U-shaped gripping frame 241 by way of a vertical pivot pin 243. As seen in FIGS. 14*a*, 29, and 29*a*, gripping frame 241 has a vertical wall 245 and an opposed pair of upper and lower horizontal gripping walls 247 and 249 respectively between which support block 238 is slidingly positioned. Vertical wall 245 is preferably positioned inwardly and lateral relative to feed plate 90 and lateral to support bar 234. Upper and lower gripping walls 247 and 249 prevent support block 238 from rocking. Vertical pivot pin 243 is journalled through gripping walls 247 and 249 at upper and lower bearings 251 and 253 and further positioned by a transverse locking screw 285 set through support block 238 as shown in FIG. 29*a*. As seen in FIG. 14*a*, the bottom of pivot pin 243 is journalled through the center of a toothed gear 242 which is cooperatively interconnected to a parallel aligned smaller toothed gear, or pinion, 244. The center of pinion 244 is in turned affixed to the bottom of a rotatable pivot 240. Pivot 240 is journalled through one end of support block 238 and is affixed at its upper end to base 232 of rotatable finger 224. FIGS. 29 and 29*a* also show various of these elements, but it is noted that in those figures gear 242 and pinion 244 have been rotated from their horizontal alignments shown in FIG. 14*a* to vertical alignments, as will be discussed in detail later. A grip 255 positioned at the bottom of pivot pin 243 presses against the bottom surface of gear 244. The top of pivot pin 243 is affixed to upper gripping wall 249 by a locking nut 243 that is screwed onto a threaded top of pivot pin 243, as seen best in FIG. 29*a*.

As seen in FIGS. 14*a*, 29, and 29*a*, upper wall 245 of gripping frame 241 forms an elongated aperture 259 between vertical walls 247 and 249. The end 261 of support block 238 opposite pivot 240 extends through aperture 259 so that support block 238 is allowed free play as it rotates about pivot pin 243. As seen in FIGS. 14*a*, 29, and 29*a*, support bar 234 forms through its center an elongated slideway 263 seen as vertical in FIG. 14*a* and as horizontal in FIG. 29. Locking nut 257 of pivot pin 243 is positioned in non-rotatable alignment in slideway 263 as seen in FIG. 29*a*. A locking bolt 269 extends through slideway 263 and is secured at its bottom to gripping frame 241 by a bottom locking nut threaded onto the bottom portion of threads 273 of locking bolt 269 and is secured at its top to support bar 234 by way of a top locking nut 275 threaded onto the top portion of threads 273 of locking bolt 269. Top locking nut 275 is screwed into pressing relationship with locking washer 277 which in turn presses against the outer surface of upper gripping wall 247, as best seen in FIGS. 29 and 29*a* but also as seen in FIG. 14*a*. Thus when locking bolt 269 is secured to support bar 234 and gripping frame 241 by top and bottom locking bolts 275 and 271 respectively, fingers 222 and 224 remain in a constant relationship. As seen best in FIG. 29*a*, gripping frame 241 forms an elongated dove tailed slide recess 279 along the upper surface of upper gripping wall 247. Support bar 234 includes an elongated dove tailed key 281 along its bottom surface wherein key 281 is slideably mounted to gripping frame 241 in slide recess 279. Thus, gripping frame 241 is slideably movable relative to support bar 234 and in addition is supported by support bar 234 by way of the dovetailing between the two. It is further noted that not only gripping frame 241 is slideably relative to support bar 234 and is supported by support bar 234, but the same is true of geat 242, pinion 244, support block 238, and, most significantly, finger 224 with pin pair 228.

A horizontally disposed twirl cylinder 246, which is a part of loop-forming sub-assembly 212, is disposed horizontally with air supply hose 248 connected to the common pneumatic air system at one end and flange member 250 at the other end. A plunger 252 is connected to the piston of cylinder 246 at one end and to clevis 254 at its other end. Flange member 250, which is vertically disposed in FIG. 14, is connected to horizontally disposed bend support member 256, which in turn is bent inwardly and integrally connected to a vertical post 258, which is in turn joined to horizontal support bar 234. As shown in FIGS. 30 and 31, a lever member 260 is rotatably joined to clevis 254 at an angle to plunger 252 and rotatably mounted to the underside of bend support member 256 at main lever pivot 261. A first rod 262 is rotatably connected to one end of the underside of finger base member 238 at first pivot 264 at a point past lever pivot 261. Although FIGS. 30 and 31 are in fact side views of sub-assembly 212 after being rotated from the position shown in FIG. 14, the terms "topside" and "underside" will be used as a convenience as if the gear were in the position shown in FIG. 1. The underside of the opposite end of finger base member 238 is, as was previously described, rotatably connected to the axis of pinion 244 at pivot 240. First rod 262 is disposed between the underside of base member 238 and the topside of gear 242. First rod 262 is also connected at its opposite end from first pivot 264 to lever member 260 at first lever pivot 266, which is at the opposite end of lever member 260 from clevis 254. A second rod, 268, which is disposed approximately parallel to first rod 262, is rotatably connected to lever member 260 between main lever pivot 261 and first lever pivot 266 at second lever pivot 270. Second rod 270 is also rotatably connected at its opposite end to the underside of gear 244 at second rod pivot 272. The relative sizes, or diameters, of 242 and pinion 244 are predetermined in accordance with the tasks assigned fingers 222 and 224.

A complete description of the operation of loop-forming sub-assembly 212 will include a detailed explanation of the operation of gear 242 and pinion 244. At this point, it can be noted that as plunger 252 is moved outwards, clevis 254 is likewise moved outwards away from cylinder 246 thus levering first rod 262 inwards with lever pivot 283 acting as the fulcrum point. This inwards movement of first rod 262 causes support block 238 along with annexed pinion 244 to rotate about gear pivot, or axis, 274 in a clockwise direction when viewed from the underside of the gear as seen in FIGS. 30 and 31 in cooperation with gear 242. At the same time, second rod 268 is, like first rod 262, levered inwardly about lever pivot 283, thus rotating gear 242 about its own axis 274 in a counterclockwise direction when viewed from the underside as in FIGS. 30 and 31. In summary, gear 242 is rotated about its own axis 274 in a first direction, depending on the direction of thrust of plunger 252, and pinion 244 is doubly rotated, that is, rotated both as a unit about pivot 243 in a second opposite direction from the rotation of gear 244 and in addition is twirled in the second direction about its own axis 240. As noted previously, pivot support 243 passes through support block 238 and is journaled to the top of gripping bar 241. Because gear 242 is simultaneously rotated by second rod 268, pinion 244 is twirled about its own axis an added number of revolutions or twirls than would occur if rod 268 did not simultaneously rotate the gear. This unique and novel feature enables the system to accomplish simultaneous tasks as will be discussed in full below.

Inserting mechanism sub-assembly 20 cooperates via pivot 84 with loop-forming sub-assembly 212 so as to rotate the entire loop-forming sub-assembly 212 upon actuation of insert cylinder 102 and its associated plunger 108 either toward or from the cylinder in exactly the same manner as described previously with reference to the cooperation between loop-forming sub-assembly 12 and inserting mechanism sub-assembly 20. The sequence of the activation of inserting sub-assembly 12 will be discussed fully shortly.

At this point, a unique aspect of the present invention will be set forth with respect to loop-forming sub-assembly 212. As can be seen best in FIG. 14*a*, a belt loop 276 has been mounted on pin pairs 226 and 228 of fingers 222 and 224. As will be described shortly, the distance between fingers 222 and 224 determine the overall length of belt loop 276 in its final sewn position as seen in FIGS. 15 and 32. In accordance with the present invention, this distance can be varied by a unique feature of sub-assembly 212 that allows the length of belt loop 276 as sewn to be selected according to requirements. This is accomplished by selecting the required length of belt loop 276 and then shifting pins 222 and 224 to the selected length. This is accomplished by loosening top locking nut 275 so as to free locking washer 277. This action allows gripping frame 241 to be slid relative to support bar 234 via dovetailed key 281 in dovetailed slide recess 279. This allows finger 224 to be adjusted relative to finger 222 until the desired distance between them is reached and the selected length of belt loop 276 will be achieved. At that point, top locking nut 275 is screwed against locking washer 277 so that gripping frame 241 and support bar 234 are locked together in operational relationship.

It would be advantageous to begin here the sequence of operation of system 10 before detailed descriptions of the mechanisms of clamp sub-assembly 214, gripping sub-assembly 216, and extractor sub-assembly 218 so as to present the functions of each sub-assembly first and then to diverge to set forth the operative elements of each of the three above-mentioned sub-assemblies.

Reference is now made to FIG. 15, which shows a finished task wherein belt loop 276 has been sewn, or tacked, onto the cloth material, or trouser cloth 278 both at upper tack 280 and lower tack 282. Upper tack 280 is hidden by loop 276 while lower tack 282 is passed through a double layer of the loop and is thus visible. As described previously, the hidden upper tack and the visible lower tack is the American style loop tack.

The sequence of operations of system 210 is illustrated in FIGS. 16 through 24. FIG. 16 illustrates a side view of non-rotational finger 222 with its pair of pins 226. Rotatable finger 224 is hidden by non-rotatable finger 222 as are its pair of pins 228 by pins 226. Fingers 222 and 224 via their pins 226 and 228 hold loop 276. Fingers 222 and 224 are in the upright loading position of the sequence just after the loading of loop 276 in the pins of the fingers by the operator. This upright position of the fingers is also shown in the perspective view in FIG. 14.

It must be set forth that system 10 must be prepared for the American style tacking. It is first necessary that feed plate 90 be shifted to its outer position so that needle 160 is set over inner hole 98 of feed plate 90. It is also necessary that fingers 222 and 224 be positioned as shown in FIG. 14 and as described for FIG. 16. As will be explained, rotatable finger 224 can be rotated between its inner position as shown in FIG. 14, where it is positioned to the inside of both needle 160 and finger 222, and a second position where it is positioned outside of needle 160 and finger 222. This second position is a necessary prelude to preparing for the European tack, which will be explained later. Finally, gripper 288 is extended outwardly in a manner that will be explained later.

With system 10 ready for the American tack and the upright fingers mounted with belt loop material 276, the next step of the sequence is commenced and is shown in its completed phase in FIG. 17. This step is the rotation of loop-forming sub-assembly 212 by actuation of cylinder 102 of inserting sub-assembly 20. As explained in relation to the first embodiment of FIG. 1, sub-assembly 20 has two movements; first, a rotational movement whereby pivot 84 rotates loop-forming sub-assembly 212 so that fingers 222 and 224 rotate to an approximately horizontal position, as shown in FIG. 17; and second, a movement that causes sub-assembly 212 to move laterally so that belt loop material 276 is inserted over the sewing station under needle 160 and over inner hole 98. As also shown in FIG. 18, belt loop 276 is also positioned under inner clamp 284 of clamping system 216, which will be discussed. Motion of loop sub-assembly 212 as motivated by inserter sub-assembly 20 here ceases, and a sequence of steps begins related to the other sub-assemblies.

FIG. 19 illustrates in schematic fashion a view of pin pairs 226 and 228 taken head on from across plate 90 with fingers 222 and 224 not shown. Clamp 284 is also shown in section. In addition, gripper 288, including upper grip 290 and lower grip 292 of gripping sub-assembly 216 are also shown. FIG. 19 in fact illustrates the same step as shown in FIG. 18. The next step of system 210 is illustrated in FIG. 20. Here, pins 226 along with belt loop material 276 have undergone a double movement as a result of actuation of cylinder 246 of loop sub-assembly 212. What occurs here is that rotatable finger 224 has been twirled thus twirling pins 226 with the result that loop 276 has been doubled under the pins. Rotatable finger 224 along with pins 226 have been rotated through a 360 degree angle. Simultaneously, rotatable finger 224 has been rotationally shifted from a first position wherein rotatable finger 224 was on the same horizontal plane with finger 222, that is, pins 228 were on the same plane with pins 226, and in addition was positioned beyond gripper 288, specifically inwards of gripper 288 to a second position wherein pins 228 have been raised and then shifted outwardly so that they pass between upper and lower grips 290 and 292 and outwardly beyond them so that pins 226 are free of gripper 288 and is positioned over the remainder of belt loop 276. As shown in FIG. 20, when pins 226 have been twirled, the portion of the loop material that extended beyond pins 226 now extends back between upper and lower grips 290 and 292.

Before proceeding to the next step in the sequence, a digression will be made here to clarify the relationship between the double rotation and movement of pins 226 from FIG. 19 to FIG. 20 and the mechanism of loop-forming sub-assembly 212. This double task is accomplished according to the present invention by the novel and unique gear 242 and pinion 244 construction and arrangement in conjunction with cylinder 246. The activation of cylinder 246 in accordance with a programmed sequence for system 210 for the American style tack causes the movements of the gear and pinion. FIG. 30 illustrates loop sub-assembly 212 after it has been rotated from the vertical position of FIG. 16 to the horizontal position of FIG. 17, and then to the inserted position of FIGS. 18 and 19 and finally to the twirled position of FIG. 20. This position also corresponds to the position of loop forming sub-assembly 212 shown in FIG. 29 in plan view. The phantom lines of FIG. 29 indicate gear 242 and pinion 244 along with fingers 222 and 224 in the withdrawn position. Turning back again to FIG. 30, plunger 252 has been pulled into twirl cylinder 246 from its position illustrated in FIG. 14, where plunger 242 is shown extended out from cylinder 246. FIG. 30 in summary shows the position of the pinion when rotatable finger 224 has been lowered, inserted under the sewing station, been rotated between upper and lower grips 290 and 292, and finally, has been twirled so that loop material 276 is rolled around pins 228. Going now to FIG. 31, plunger 252 has been thrust outwardly from twirl cylinder 246 and second rod 268 has rotated gear 242 counterclockwise and first rod 262 has rotated pinion 244 around the circumference of gear 242. This movement rotates pins 244 from between upper and lower grips 290 and 292 and returns rotatable finger 224 to the position shown in FIGS. 18 and 19. In fact, because of its relation to the phantom line position of FIG. 29, FIG. 31 is in fact an illustration of the position of loop-forming sub-assembly 212 in its position as indicated in FIG. 17. Regarding pinion 244, its twirling rotation about its own axis 240 is caused by the rotational cooperation of its circumferential teeth with the circumferential teeth of gear 242. The rotation of pinion 244 via first rod 262 and finger base member 238 causes pinion 244 to twirl about its own axis 240, thus causing pins 228 of rotatable finger 224 likewise to twirl, since pivot 240 passes through base member 238 and is journaled to the bottom of finger base member 232. As has been explained in relation to the movement of pins 228 in FIGS. 18 and 19 to pins 228 in FIG. 20, pins 228 must rotate 360 degrees to accomplish the task of positioning loop 276 as shown in FIG. 20. To accomplish the 360 degree twirl in the space allocated to gear 242 and pinion 244, gear 242 is also rotated contrary to the direction of rotation twirl of pinion 244, thus adding to the twirling of pinion 244 and accomplishing the 360 degree twirl within the rotational movement of pinion 244 about pivot 243. In the movement indicated from FIGS. 30 to 31, an untwirling and unrotation of pins 228 is set forth. This can only be accomplished when pins 228 have been withdrawn from loop 276. This will be described below. The movement backwards from FIG. 31 to FIG. 30 is simply that of the steps shown beginning with FIG. 17 and ending with FIG. 24.

The procedure from the position shown in FIG. 20 is followed by the step indicated in FIG. 21 where upper grip 290 of gripping sub-assembly 216 is dropped down and grips loop 276 against lower grip 292, specifically at the end of loop 276, which is designated as loop end 294. One of the pair of pins 228 is thus encircled by loop 276 and loop end 294. In addition to this movement of gripping sub-assembly 216, FIG. 21 also illustrates inner clamp 284 of clamp sub-assembly 214 having been moved downwards to pinch, or clamp, the flat end 296 of loop cloth 276 extending beyond pins 226 and which is positioned under clamp 284, so that end 296 is pressed against trousers 278 in feed plate 90. This double movement downwards of loop material 276 by upper grip 290 and clamp 284 causes pins 226 and 228 to move downwards, since fingers 222 and 224 along with their pins are sufficiently flexible to allow such a downwards movement. In FIG. 21, the first upper positions of the pins is designated as 226' and 228' shown in phantom lines and the second lower position as 226 and 228. In addition, the upper clamp is designated as 290' in phantom in the upper position and as 290 in solid in the lower position; and the clamp as 284' in phantom in the upper position and 284 in solid in the lower position. As explained earlier, inner and outer clamps 284 and 286 are elements of clamping sub-assembly 214, which, except for clamps 284 and 286, is constructed and arranged in exactly the same manner as clamping sub-assembly 16 discussed in relation to system 10 as shown in FIG. 1. Clamps 284 and 286 are connected to support rod 168 at clamp holders 298 and 300 at clamp brackets. Flat outer clamp portions 302 and 304 extend from the clamp brackets approximately parallel to the surface of feed plate 90. It is noted that clamps 284 and 286 are situated slightly outwards of holes 98 and 100 respectively in the outer position of feed plate 90 as shown in FIG. 14. In the inner position of feed plate 90, hole 100 shifts to the exact location where hole 98 had been, thus keeping inner clamp 284 proximate to but not over hole 98. As explained earlier, pneumatic clamping cylinder 182 operates the clamping linkage so as to pivot support rod 168. Details of the linkage are shown in FIG. 13. Cylinder 182 cannot be seen in the perspective of FIG. 14 but can be seen in FIG. 27.

The next step in the American style tacking sequence is shown in FIG. 22. Here, fingers 226 and 228 have been withdrawn by activation of insert cylinder 102 of insert sub-assembly 20 as described earlier in relation to the first embodiment of system 10 of FIG. 1. This withdrawal is followed by activation of the needle and the tacking operation where the hidden upper tack is made wherein loop 276 is sewn to trouser cloth 278 proximate to flat end 296.

FIG. 23 illustrates the following step in the operation. Here plate/shifter sub-assembly 18 is activated to move from its initial outwardly positioned alignment at 90' where it had been set in preparation for the American style tacking operation, to its other inwardly positioned alignment at 90. In the outward alignment, inner hole 98 in feed plate 90 is situated at the sewing station under needle 160; while in the outward alignment, outer hole 100 is situated at the sewing station under needle 160. As noted previously, feed plate 90 is part of feed plate/-shifter sub-assembly 18, which is the same in all respects as that described in relation to system 10 in FIG. 1. As described there, feed plate 90 is shifted via activation of pneumatic cylinder 184. Cylinder 184 is shown in FIGS. 14 and 27 and also in FIG. 13 in detail. FIG. 23 also shows loop cloth 276 having been inwardly shifted along with feed plate 90, since the loop is tacked to trousers 278, which are also shifted inwardly with plate 90. As belt loop 276 is moved inwardly, it wraps around inner clamp 284 while gripper 288 is stationary but moving relative to feed plate 90, as indicated by the initial position of gripper 288 as 288'. Gripper 288 is thereupon moved outwards to a position inwards of and proximate to needle 160 and hole 100 so that the double end tip of loop 276 is directly over hole 100 and under needle 160. At this position, gripper 288 undergoes a second movement, namely, a movement downwards to feed plate 90 and specifically wherein lower grip 292 is pressed against trouser cloth 278. This double movement of gripper 288 will be explained below in relation to the linkage and operation of gripping sub-assembly 216, which is operated via three pneumatic cylinders, each of which is programmed to the pneumatic circuitry so as to be activated to operate in the proper sequence with the other pneumatically operated cylinders of cooperating sub-assemblies of system 210. FIG. 23 in addition indicates the tacking operation of needle 160 through double end tip 306 wherein the lower visible tack is made and the sewing of belt loop 276 to trouser material 278 is completed.

The final step of the sequence is illustrated in FIG. 24. Here extractor 308 is activated, specifically by clamping extractor upper finger 310 against extractor lower finger 312. It is explained at this point that in order to prepare the trousers for the extracting operation, the operator, preferably at the start of the entire sequence, drapes trouser cloth 278 over both feed plate 90 and in addition over lower extractor finger 312. Lower extractor 312 is indicated in hidden, or dotted, lines in FIG. 14. FIG. 24, which is a view taken through line 24—24 of FIG. 23, indicates extractor 308 already in the clamped position with trouser cloth 278 between upper and lower extractor fingers 310 and 312. It is understood that trouser material 278 had already been draped over lower finger 312. Once extractor 308 has been activated to clamp trouser cloth 278, extractor 308 is again moved sideways towards loop sub-assembly 212 so that trouser material 228 along with sewn loop belt 276 so that belt loop 276 is pulled free of both inner clamp 284 and gripper 288, particularly lower gripper 292, both of which are enclosed by the belt loop. This sideways movement is only sufficient to extract the belt loop and to move it to the phantom line position designated as 276' with the trouser cloth designated as 278' and the upper and lower extractor also shown in phantom in the shifted position as 310' and 312'. The trousers can then be lifted from feed plate 90 by the operator. The system is then, and has already been in the case of certain sub-assemblies, sent back to the ready position in preparation for a new sequence. In normal operation, the operator has already loaded a new belt loop onto pins 226 and 228.

A discussion of gripping sub-assembly 216 and of the extractor sub-assembly 218 will now proceed.

Views of the gripping sub-assembly 216 are seen in the perspective view of FIG. 28, in the top plan view of FIG. 25, in the elevational view of FIG. 26, and in the rear view of FIG. 27. Gripper 288, which includes upper grip 290 and lower grip 292 as seen in FIG. 14 and in FIGS. 19 through 23 of gripping sub-assembly 218, have already been discussed. Gripping subassembly 218 is mounted within an upper casing 313 and a lower casing 315 held together by a vertical joining plate 317. Lower casing 315 is secured to frame 319 by conventional means. FIG. 28 shows in detail the linkage of lower grip 292 which is connected to a central support 314 by arm 316. Gripper pivot 327 extends transversely through central support 314. Gripper pivot 319 is seen on FIGS. 25 and 28. It is noted that gripping sub-assembly 216 is slidably mounted within casings 313 and 315, specifically on upper and lower plate mounts 321 and 323 which are slidably mounted on four corner slide fittings 325. Gripper pivot 319 is secured to lower plate mount 323 in a conventional manner.

Lower grip 292 is connected to central support 314 by arm 316. A horizontal grip-closing pneumatic cylinder 318 is connected to central support 314 by a flange 320. A plunger 322 connected to the piston of cylinder 318 is connected to a first clevis 324 slidably mounted on central support 314. Clevis 324 in turn is connected to a second clevis 326 by lever 328. Upper grip 290 is connected to central support 314 via arm 329 at pivot 330. Pivot arm 332 connects pivot 330 with clevis 326. Activation of grip-closing cylinder 318 pushes out plunger 322 which slides clevis 324 and operates linkage lever 328 and arm 329 to close upper grip 290 upon lower grip 292. The result of this operation is seen in FIG. 21. Reversal of plunger 322 operates to raise upper grip 290 from lower grip 292. A horizontal shifting cylinder 334 mounted approximately parallel to grip-closing cylinder 318 is connected to central support 314 by a mounting bar 336 which in turn is fixed to a plunger 338 connected to the piston of shifting cylinder 334. When pneumatic shifting cylinder 334 is activated, its piston thrusts plunger 338 forward thus shifting central support 314 forward and with both upper grip 290 and lower grip 292. The result of this motion is seen in FIG. 23. A third pneumatic cylinder, namely vertical dropping cylinder 340, is shown in FIG. 27. A plunger 342 is connected to the piston of dropping cylinder 342. At the bottom end of plunger 342 is knob 344 that is capable of coming into pressing contact with horizontal seat 346, which in turn extends a support bar 348 that is connected to a horizontal transverse grip pivot 350. When pneumatic dropping cylinder 340 is activated, its piston forces plunger 338 and knob 344 into pressing contact with support bar 348 which then swivels downward. At the forward end of support bar 348 is transverse forcing bar 352 which is likewise forced downwards to come into contact with vertical anvil 354 in turn connected to arm 316 of lower grip 292. This downward action forces down both upper grip 290 and lower grip 292 by way of rotation of arm 316 about gripper pivot 327.

Turning now to extractor sub-assembly 218, extractor 308 including upper extractor finger 310 and lower extractor finger 312 can be seen in FIG. 14, with lower extractor finger 312 seen in dotted lines. A centrally located vertical pneumatic clamping cylinder 360 seen in FIG. 14 connected to upper finger 310 by plunger 362 connected to the piston of clamping cylinder 360 by clevis 370 with associated conventional linkage. When clamping cylinder 360 is activated, plunger 362 operates to press top finger 310 down upon bottom finger 312 via the linkage. This action has been described in the discussion relating to FIG. 24. A second pneumatic extractor cylinder, namely extractor shifting cylinder 364 is likewise viewable in FIG. 14. Shifting cylinder 364 is, like extractor clamping cylinder 360, connected to the pneumatic air system described earlier at line 366. Shifting cylinder 364 can also be seen in the plan view of FIG. 29. A vertical mounting bar 368 is fixedly connected to clevis 370. Vertical mounting bar 368 along with upper and lower extractor fingers 310 and 312 is transversely moveable relative to vertical support frame 372, which in turn is rigidly connected to the frame of system 210 by conventional means. In particular, mounting bar 368 is fixedly connected to horizontal transverse slide rod 373, which in turn is slidably connected to vertical support frame 372. Shifting cylinder 364 is rigidly connected to the side of vertical support frame 372 on the surface opposite to vertical mounting bar 368. Plunger 374 extends from the piston of shifting cylinder 364 and is rigidly connected at its far end to the wall of vertical mounting bar 368. When shifting cylinder 364 is activated, plunger 374 is pulled inwards away from feed plate 90 for a short distance. This action causes trouser material 278 to be pulled slightly across feed plate 90 so that belt loop 276 is pulled free from gripper 288. A subsequent signal can activate shifting cylinder 364 to drive plunger 374 outwards and so return the extractor fingers to their original position ready for the next operation. Attention is now directed to FIG. 32, which illustrates a belt loop sewn to a trouser in the European style where the top of the loop has a visible tack 380 and the bottom of the loop has a hidden tack 382. FIGS. 34 through 41 illustrate the step-by-step process by which this task is accomplished on the second embodiment of the present invention as illustrated in system 210 shown in FIG. 14.

Before beginning this sequence, system 210 must first be prepared by first shifting feed plate 90 inwards so that hole 100 is directly under needle 160. Next, rotatable finger 224 must be rotated to the outside position, that is, to the outside of stationary finger 222. This is accomplished by activating twirl cylinder 246 so that plunger 252 is pulled inwards so that the position shown in FIG. 30 is accomplished, except that fingers 222 and 224 remain upright. In this position belt loop material 276 is inserted between pins 226 and 228. Finally, the plunger of shifting inserter cylinder 334 must be positioned in an extended position so as to extend gripper 288 in an outward position.

The sequence begins with FIG. 33 with rotatable finger 224 visible along with its pins 228 and hiding finger 222 and its pins 226. Pins 226 and 228 hold belt loop 276. Outer clamp 298 is seen as are needle 160, feed plate 90, and trouser material 278. Inserting mechanism sub-assembly 20 is operated via its insert cylinder 102 to rotate loop-forming sub-assembly 212 so that fingers 222 and 224 reach the horizontal positions seen in FIG. 34 and then are moved toward feed plate 90 as shown in FIG. 35 again by action of inserter sub-assembly 20. With FIG. 36 picking up at the position shown in FIG. 35, it can now be seen that rotatable finger 224 is positioned out beyond the end of feed plate 90. Outer clamp 286 is shown as are upper grip 290 and lower grip 292. At this point twirl cylinder 246 is activated and pins 228 are both rotated and twirled so as to pass twirl loop end 384 between upper and lower grips 290 and 292 and to twirl about pivot 240. This position is shown in FIG. 37. The next step resulting in the position shown in FIG. 38 is accomplished by a double activation; that is, upper clamp 290 is dropped upon lower clamp 292 by activation of grip-closing cylinder 318; and outer clamp 286 is dropped downwards by activation of clamping cylinder 182. It is noted that this double action pulls belt loop 276 downwards since fingers 222 and 224 are sufficiently flexible to respond to the pressure upon the belt loop. At this time inserter sub-assembly 20 is activated to pull back fingers 222 and 224 from contact with belt loop 276. While the steps described below follow, fingers 222 and 224 are rotated back to their positions as described for indicated in FIG. 33 so that the operator will be able to load the pins with loop material for the next sequence. Upon withdrawal of the pins, as indicated in FIG. 39, the tracking operation can now begin for the hidden lower tack of the loop, again as indicated in FIG. 39. Under completion of the lower tack, feed plate 90 is moved outwards by activation of shift cylinder 184 so that hole 98 is positioned under needle 160. Inner clamp 284 rides along with plate 90 as does trouser material 278 and the bottom portion of loop 276. At this time gripper 288 is shifted inwards by action of shifter cylinder 334, which, as explained, was positioned in extended position in preparation for the European style tacking operation. As seen in FIG. 40, gripper 288 is then dropped by activation of dropping cylinder 340, thus pressing double end tip 386 in proximity to trouser material 278 in preparation for needle 160 to accomplish the exposed upper tack. Finally, extractor sub-assembly 218 is activated via extractor clamping cylinder 360 so that upper finger 308 drops to grip trouser material 278 against lower finger 310; and extractor shifting cylinder 364 is activated to pull extractor 308 along with trouser material 278 sideways to free the belt loop from gripper 288. It is noted that trouser material 278 has been draped over lower extractor finger 312 at the beginning of the operation.

When an American style tack is required, the system is prepared by shifting feed plate 90 outwards so that hole 98 is under needle 160. Next, rotatable finger 224 is rotated to the position shown in FIG. 14. Finally, the plunger of shifting inserter 334 is moved to a withdrawn position.

All cylinders discussed are pneumatic and connected by air lines to the same pneumatic air system. In addition, all the pneumatic operations are circuited and programmed to operate automatically in proper sequence depending on the type of operation required.

Finally, it is noted that for system 210 one operation is operated by way of expansion spring 388 as shown in FIGS. 26, 27, and in part in FIG. 28. Expansion spring 388 is integral with gripping sub-assembly 216. When dropping cylinder 340 is activated to act to drop gripper 288 in the manner described previously, expansion spring 388 is expanded to a biased position. The top of expansion spring 388 is connected to fixed frame member 390 and the bottom is connected to rotatable support bar 348. When the pneumatic power source is withdrawn from dropping cylinder 340, expansion spring 388 retracts to raise rotatable support bar 348 upwards about gripper pivot 327 to the raised position for gripper 288.

The embodiments of the present invention as particularly disclosed are presented merely as examples of the invention. Other embodiments, forms, and modifications of the invention coming within the proper scope of the appended claims will, of course, readily suggest themselves to those skilled in the art.

What is claimed is:

1. A loop setting system comprising, in combination:

a first pair of pin members extending substantially in a first direction, a second pair of pin members spaced from said first pair of pin members and extending substantially parallel with respect to said first direction, said first and second pairs of pin members each defining respective first and second slots therebetween capable of receiving therein relatively remote portions of material to be manipulated to form a folded configuration capable of joinder with other material, means for arcuately moving at least one pair of pin members, thereby accomplishing said folding manipulation and positioning the formed configuration with respect to a reference plane, said first pair of pin members extending substantially in a first direction a predetermined distance from a first reference axis, said second pair of pin members spaced from said first pair of pin members and extending substantially parallel with respect to said first direction a predetermined distance from a second reference axis, means for arcuately moving said first and second pairs of pin members about said respective first and second axes, thereby accomplishing said folding manipulation and positioning the formed configuration with respect to a said reference plane, said first pair of pin members being disposed such that all points along a line joining said first pair of pin members are spaced a pre-determined distance from said first axis, at least one pair of pin members having an axis of rotation spaced a predetermined distance from and substantially parallel to a reference axis, means for rotating said one pair about said axis of rotation, means for simultaneously arcuately moving said one pair about said reference axis, and means for positioning said one pair with respect to said reference plane, thereby accomplishing said folding manipulation and positioning the formed configuration with respect to said reference plane.

2. A loop setting according to claim 1, further including means for moving one set of said first and second pin members relative to the other set whereby the length of said material received in the first and second pin members may be varied.

* * * * *